US005643380A

United States Patent [19]

Saitoh et al.

[11] Patent Number: 5,643,380

[45] Date of Patent: Jul. 1, 1997

[54] METHOD OF RECYCLING IMAGE-DEPOSITED RECORDING MATERIAL AND APPARATUS FOR RECYCLING THE SAME

[75] Inventors: Tadashi Saitoh; Kiyoshi Tanikawa, both of Yokohama; Kakuji Murakami, Kamakura; Toshiaki Tokita, Zama; Shigeru Fujita, Machida, all of Japan

[73] Assignee: Ricoh Company, Ltd., Tokyo, Japan

[21] Appl. No.: 394,761

[22] Filed: Feb. 27, 1995

[30] Foreign Application Priority Data

| | | | |
|---|---|---|---|
| Feb. 25, 1994 | [JP] | Japan | 6-052761 |
| Feb. 28, 1994 | [JP] | Japan | 6-054532 |
| May 26, 1994 | [JP] | Japan | 6-112411 |
| Feb. 2, 1995 | [JP] | Japan | 7-037522 |

[51] Int. Cl.[6] ..... B08B 1/02; G03G 21/00

[52] U.S. Cl. ..... 156/94; 156/230; 156/236; 156/389; 134/15; 134/39

[58] Field of Search ..... 156/230, 236, 156/94, 389, 390; 134/15, 39; 430/49, 125, 117; 355/307; 15/77, 102

[56] References Cited

U.S. PATENT DOCUMENTS

| | | | |
|---|---|---|---|
| 4,793,860 | 12/1988 | Murakami et al. | 106/22 |
| 5,006,189 | 4/1991 | Tsukamoto et al. | 156/390 |
| 5,353,108 | 10/1994 | Tsukamoto | 156/389 |
| 5,474,617 | 12/1995 | Saito et al. | 134/15 |

FOREIGN PATENT DOCUMENTS

| | | | |
|---|---|---|---|
| 54-22215 | 2/1979 | Japan | 156/236 |
| 83-01757 | 5/1983 | WIPO | 156/236 |

*Primary Examiner*—Jill L. Heitbrink

*Attorney, Agent, or Firm*—Oblon, Spivak, McClelland, Maier & Neustadt, P.C.

[57] ABSTRACT

A method of recycling an image-deposited recording material having a surface portion which swells in contact with water and bears thereon deposited images containing an image-constituting material, include the steps of: (a) applying a water-containing image removal promoting liquid to the image-deposited surface portion of the recording material, (b) bringing an image release member into contact with the image-deposited surface portion of the recording material to transfer the images to the image release member to remove the images from the image-deposited recording material, and (c) applying heat to the image-deposited recording material at least after the step (a), with substantially retaining the water component of the image removal promoting liquid in the image-deposited surface portion. In addition, there is disclosed an apparatus for recycling the above-mentioned image-deposited recording material comprising an image removal promoting liquid application means, a water evaporation preventing means, a heat-application means for heating the image-deposited recording material in such a manner that the water component of the image removal promoting liquid is retained in the surface portion, and an image release means.

68 Claims, 14 Drawing Sheets

FIG. 2
FIG. 2(a)
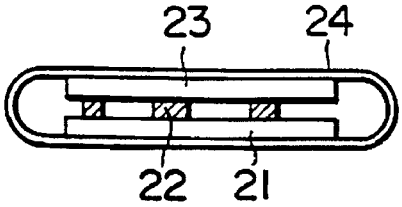
FIG. 2(b)
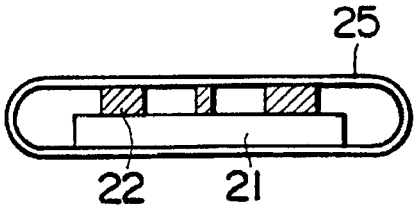
FIG. 2(c)
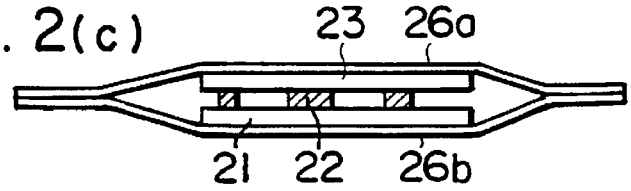
FIG. 2(d)
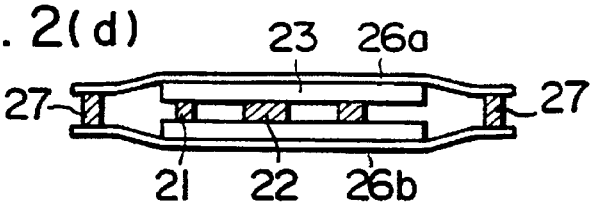
FIG. 2(e)
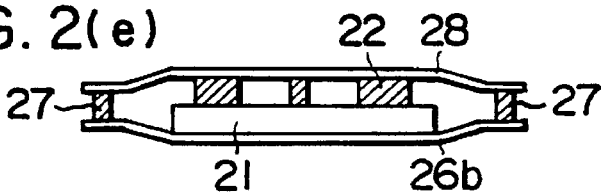
FIG. 2(f)
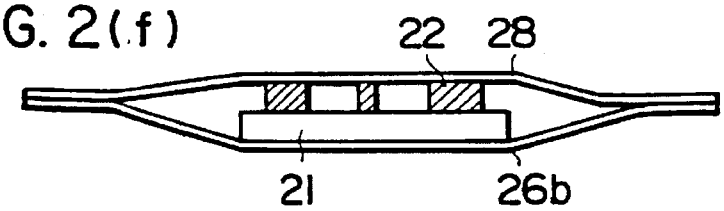
FIG. 2(g)
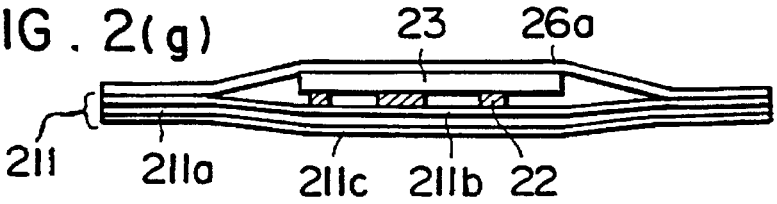
FIG. 2(h)
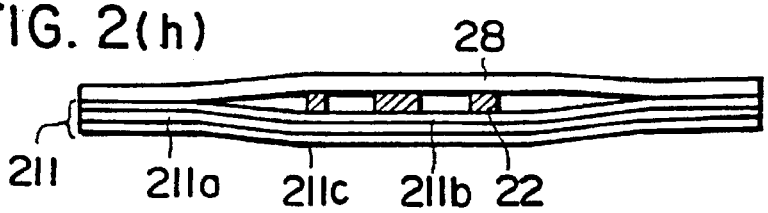

METHOD OF RECYCLING IMAGE-DEPOSITED RECORDING MATERIAL AND APPARATUS FOR RECYCLING THE SAME

BACKGROUND OF THE INVENTION

1. Field of the Invention

The present invention relates to a method for recycling a recording material comprising at least a surface portion which swells in contact with water, and bears thereon deposited images by the electrophotographic method, the thermal transfer method or the ink-jet method using a hot-melt ink; and an apparatus for recycling the above-mentioned image-deposited recording material.

The method and apparatus for recycling the image-deposited recording material according to the present invention can be applied to a media board capable of automatically erasing the images formed thereon.

2. Discussion of Background

With the recent spread of printers and copying machines employing various kinds of image forming processes such as an electrophotographic method, thermal transfer method or ink-jet method using a hot-melt ink, a large quantity of papers have been used and consumed. This has caused the problems of the environmental disruption of the earth due to deforestation because papers generally used as recording materials contain pulp as a raw material. In addition, with the increase of consumption of the papers, the problem of waste treatment has become serious.

A transparent sheet is also used as the recording material for an overhead projector (OHP). Such a transparent sheet employs as a base material a plastic film such as a polyester film. Most of the raw materials for use in such a plastic film are made of petroleum. It is therefore desired to make efficient use of resources with the drain of oil resources taken into consideration. In addition, most plastic films have no biodegradability, so that after these plastic films are discarded, they will float on the ocean as dust. It follows as a consequence that the environmental disruption is induced.

Conventionally, in order to solve the above problems, used papers or films are collected and subjected to beating or melting again to recycle such recording materials. However, the energy cannot be efficiently used in this recycling method, with the result that the cost may become higher as compared with the case where papers and films are made of new raw materials, or the quality of the papers and films obtained by the above-mentioned recycling method is lowered.

There is proposed a method for recycling papers and films on which images are deposited by the electrophotographic process, as disclosed in Japanese Laid-Open Patent Applications 1-101576 and 1-101577. According to this method, a toner-image-bearing copy paper or film is immersed into a solvent in which toner images formed on the copy paper or film are soluble, and is then subjected to an ultrasonic wave treatment, thereby removing toner images form the copy paper or film. Since the solvents commonly used in this method, such as acetone/trichlene and methyl butyl ketone, are ignitable and toxic, this method is not good from the viewpoints of safety and hygiene. Further, this recycling method is achieved by dissolving the toner images in the solvent, so that the solvent is contaminated with the toner in a short period of time. Therefore, a large quantity of solvent is required. In addition, there is the problem that the toner component once dissolved in the solvent is again deposited to the surface of the paper to induce the toner deposition. It is very difficult to solve such problems.

There is proposed a method for recycling a recording material made of a non-absorbent material such as plastics, metals, papers into which liquids hardly penetrate, and ceramics, as disclosed in Japanese Laid-Open Patent Application 1-297294. According to this recycling method, a thermofusible releasing member is overlaid on the toner-image-bearing recording material with the application of heat thereto, whereby toner images are peeled from the recording material.

Furthermore, there is proposed a sheet-shaped image-bearing member for supporting images thereon as disclosed in Japanese Laid-Open Patent Application 4-67043. This image-bearing member can be reused by making one side of the sheet releasable, and this kind of sheet is distinguished from a plain copy paper by marking the sheet.

In those recycling methods, however, not only plain copy papers cannot be used as the recording materials, but also it is necessary to select a recording material with poor adhesion to the toner images or to subject a recording material to releasing treatment in order to facilitate the removal of the toner images from the recording material. In such recycling methods, easy peeling of the images from the recording material means insufficient fixing performance of the recorded images. Therefore, when the images deposited on the recording material are rubbed by the clothes and the fingers, the images easily fall off the recording material and the clothes and fingers are stained with toner.

To solve the aforementioned problems, the inventors of the present invention have proposed a method for recycling an image-bearing recording material, at least part of the recording material comprising a paper layer which comprised cellulose fibers, as disclosed in Japanese Laid-Open Patent Application 5-202557. This recycling method comprises the steps of impregnating the image-bearing recording material with a water-containing liquid to weaken the adhesion between the paper layer and a thermally flexible ink deposited on the paper layer of the recording material; and bringing an image release member into pressure contact with the image-bearing surface of the recording material; and peeling the ink from the paper layer. This recycling method has the advantages that images formed on a plain copy paper for general use can also be removed therefrom, and there is no problem in terms of safety.

In Japanese Laid-Open Patent Application 5-96619, the inventors of the present invention have proposed an apparatus for recycling the image-bearing recording material to embody the recycling method as disclosed in Japanese Laid-Open Patent Application 5-202557. It is found that this recycling method can be applied to not only the above-mentioned recording material mainly comprising the cellulose fibers, but also a recording material comprising at least a surface portion capable of swelling in contact with water and bearing deposited images.

The conventional recycling method as disclosed in Japanese Laid-Open Patent Application 5-202557, however, has the drawbacks. Namely, when the recording material bears a lot of solid images thereon, it is difficult to separate the image release member from the image-bearing recording material. In such a case, a large quantity of water-containing liquid (hereinafter referred as an image removal promoting liquid) must be applied to the recording material to perfectly remove the images from the recording material. Further, the temperature must be considerably increased when the images are transferred from the recording material to the image release member. In addition, the kind of recording material and the kind of material for use in the image are relatively limited to carry out this recycling method.

The drawbacks of the conventional recycling method will now be explained in detail by referring in FIG. 1.

According to the recycling method of Japanese Laid-Open Patent Application 5-202557, the image removal promoting liquid is applied to the image-bearing recording material to decrease the adhesion between the image and the recording material, and the image release member to which the image can adhere more easily than to the recording material is brought into contact with the image-bearing surface of the recording material with the application of pressure and/or heat thereto, thereby transferring the ink image from the recording material to the image release member.

FIG. 1 is a schematic view which shows one embodiment of an apparatus for achieving the above-mentioned conventional recycling method. An image-bearing recording material 15 placed on a paper-feed tray 1 is sent to a guide plate 3 by a paper-feed roller 2 and led to an image release roller 5 by a transporting roller 4, with the image-deposited surface of the recording material 15 being directed to the guide plate 3. In this structure, an image removal promoting liquid 7 is supplied to the surface of the image release roller 5 by means of a liquid supply roller 6. Therefore, the image removal promoting liquid 7 is applied to the image-bearing recording material 15 as the recording material 15 is transported along the image release roller 5, so that the image-bearing surface of the recording material 15 is impregnated with the image removal promoting liquid 7. After the image-bearing recording material 15 is caused to pass through a nip between the image release roller 5 and a heat application roller 8 with the application of heat and pressure to the recording material 15, the recording material 15 is separated from the image release roller 5 by means of a separating claw 9.

The components for constituting the image (hereinafter referred to as an image-constituting material) transferred to the image release roller 5 are cleaned by a cleaning member 10, and then the image removal promoting liquid 7 is again applied to the surface of the image release roller 5 for the next recycling process.

The recording material 15 free from images separated from the image release roller 5 is lead to a drying belt 12 by a first transporting roller 11 to dry the recording material 15. Then, the recording material 15 is transported to a paper receiving tray 13 by a second transporting roller 11. The recording material 15 discharged to the paper receiving tray 13 is cleared of the images, so that it is ready to be reused.

One of the drawbacks in such an embodiment of the conventional recycling method is that when a plain paper is used as the recording material 15, it is necessary to apply the image removal promoting liquid 7 to the paper to such a degree that the paper is substantially saturated with the liquid 7 in order to perfectly peel the images from the paper. When a large amount of image removal promoting liquid is applied to the recording material, the energy required to dry the recording material is increased. It is therefore impossible to carry out the recycling process as high speed. A plain paper swells in contact with the water component contained in the image removal promoting liquid, so that the stiffness of paper is decreased, with the result that it is made difficult to transport the wet paper in the recycling apparatus as shown in FIG. 1, and the size of paper finally becomes different from the original size. In addition, when a large quantity of image removal promoting liquid must be applied, the size of container for storing the image removal promoting liquid therein necessarily increases, thereby making the size of the recycling apparatus bigger. Furthermore, when the image-free recording material is dried, a large amount of water is evaporated, so that there are the problems that the humidity abnormally increases in the recycling apparatus, and the water vapor is condensed in the recycling apparatus to induce the trouble of electrical circuits.

The other problems of the above-mentioned conventional recycling method is that is may be difficult to separate the recording material from the image release member after the images are attached and transferred to the image release member by the application of heat and pressure thereto. The occurrence of this problem depends upon the kind of material for use in the recording material, the king of image-constituting material, and the kind of image pattern formed on the recording material. One of the reasons for this problem is that the adhesion of the image to the recording material cannot sufficiently be reduced even though the image removal promoting liquid is applied to the image-deposited surface of the recording material. When the area of image portions is relatively small in the entire recording material, the recording material can readily be separated from the image release member with no difficulty. In the case where the image pattern formed on the recording material includes many solid images, the separation of the recording material from the image release member becomes difficult because the contact are of the recording material and the image release member is large.

SUMMARY OF THE INVENTION

It is therefore a first object of the present invention is to provide a method for efficiently recycling a recording material on which images comprising a thermoplastic or thermofusible material are deposited by the image forming methods such as an electrophotographic process, thermal transfer process or ink-jet process using a hot-melt ink, to obtain an image-free recording material without any toner deposition.

A second object of the present invention is to provide an apparatus for recycling the aforementioned image-bearing recording material, free from the conventional shortcomings.

More specifically, objects of the present invention are to provide a method and an apparatus for recycling an image-bearing recording material, in which method and apparatus the energy required for recycling the image-bearing recording material can be reduced, the processing speed can be increased, the image-bearing recording material can be transported with reliability, the change in size of the recording material subjected to the recycling process can be prevented, the recycling system can be made simple to minimize the apparatus in size, and the troubles caused by evaporation of a large amount of image removal promoting liquid can be avoided.

Furthermore, objects of the present invention are to provide a method and an apparatus for recycling the image-bearing recording material, in which the limitation in the kind of recording material and the kind of image-constituting materials can be minimized, and the requirements for the image release member can be decreased by decreasing the thermal energy applied to the image release member to transfer the images to the image release member. In addition, the objects of the present invention are to provide a method and an apparatus for recycling the image-bearing recording material, in which the image removal can be attained safely and economically by using the image release member repeatedly, and no image-constituting material remains on the recording material without peeling of the surface portion of the recording material.

The above-mentioned first object of the present invention can be achieved by a method of recycling an image-deposited recording material comprising a surface portion which swells in contact with water and bears thereon deposited images comprising a thermoplastic or thermofusible material, comprising the steps of (a) applying a water-containing image removal promoting liquid to the image-deposited surface portion of the recording material, (b) bringing an image release member into contact with the image-deposited surface portion of the recording material to transfer the images to the image release member to remove the images from the image-deposited recording material, and (c) applying heat to the image-deposited recording material to weaken the adhesion of the images to the surface portion of the recording material at least after the above-mentioned step (a), with retaining the water component of the water-containing image removal promoting liquid in the image-deposited surface portion.

The above-mentioned first object of the present invention can also be achieved by a method of recycling an image-deposited recording material comprising a surface portion which swells in contact with water and bears thereon deposited images comprising an image-constituting material, comprising the steps of (a) applying a water-containing image removal promoting liquid to the image-deposited surface portion of the recording material, and (b) bringing an image release member into contact with the image-deposited surface portion of the recording material to transfer the images to the image release member to remove the images from the image-deposited recording material, with causing slippage to generate between the image-deposited surface portion of the recording material and the image release member.

The second object of the present invention can be achieved by an apparatus for recycling an image-deposited recording material comprising a surface portion which swells in contact with water and bears thereon deposited images comprising an image constituting material, comprising an image removal promoting liquid application means for applying a water-containing image removal promoting liquid to the surface portion of the image-deposited recording material; a water evaporation preventing means for substantially retaining the water component of the water-containing image removal promoting liquid in the surface portion to which the water-containing image removal promoting liquid has been applied; a heat-application means for heating at least the surface portion to which the water-containing image removal promoting liquid has been applied, in such a manner that the water component of the water-containing image removal promoting liquid is substantially retained in the surface portion; and an image release means comprising an image release member for removing the deposited images from the image-deposited recording material by transferring the deposited images to the image release member.

The second object of the present invention can also be achieved by an apparatus for recycling an image-deposited recording material comprising a surface portion which swells in contact with water and bears thereon deposited images comprising an image constituting material, comprising an image removal promoting liquid application means for applying a water-containing image removal promoting liquid to the surface portion of the image-deposited recording material; a water evaporation preventing means for substantially retaining the water component of the water-containing image removal promoting liquid in the surface portion of the image-deposited recording material to which the water-containing image removal promoting liquid has been applied; a heat-application means for heating at least the surface portion to which the water-containing image removal promoting liquid has been applied, in such a manner that the water component of the water-containing image removal promoting liquid is substantially retained in the surface portion; an image release means comprising an image release member for removing the deposited images from the image-deposited recording material by transferring the deposited images to the image release member, and a slippage generating means for causing slippage to generate between the surface portion of the image-deposited recording material and the image release member to transfer the deposited images to the image release member.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 2(*a*) through 2(*h*) are schematic cross-sectional views showing the examples of the recycling method according to the present invention, in which a water component of a water-containing image removal promoting liquid applied to the image-deposited surface portion of a recording material can be retained by use of a sealing member;

DESCRIPTION OF THE PREFERRED EMBODIMENTS

Figure 1:
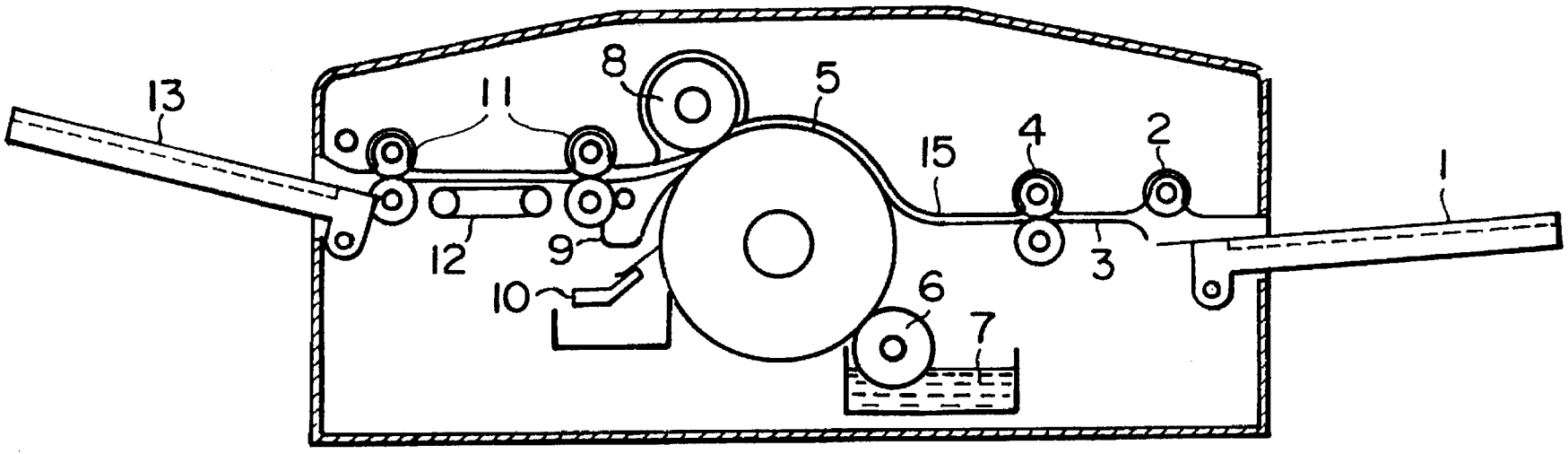
FIG. 1 PRIOR ART
FIG. 1 is a schematic view which shows one example of a conventional apparatus for recycling the image-bearing recording material.

To obtain a so-called hard copy on a recording material, there are conventionally proposed many methods; for example, the electrophotographic process using a dry or liquid toner, the thermal transfer recording process using a thermofusible ink sheet, the thermal diffusion transfer recording process using a thermally diffusing dye, the ink jet process using a hot-melt ink, the thermosensitive recording process using a material capable of inducing color formation by the application of heat thereto, the silver salt diffusion transfer process, and various printing processes such as offset printing, intaglio printing, letterpress printing and stencil printing. In the present invention, an image comprising a thermoplastic or thermofusible material is deposited in the form of a thin film on the surface portion of a recording material by the electrophotographic process, thermal transfer recording process, ink jet process, and other conventional printing processes. In this case, the whole image may not necessarily by constituted by a continuous thin film. The image in the form of a thin film means that the image-constituting material does not deeply permeate through the recording material in the thickness direction thereof, or the image-constituting material is not adsorbed substantially on the molecular level by the recording material unlike and image-constituting material such as a dye-containing water-soluble ink. For instance, when images are formed on a recording material by the electrophotographic process using a dry toner in such a fashion that toner particles do not penetrate through the inside of the recording material even though one character image is dotted and toner particles are independently deposited on the recording material, it is believe that those images can be removed from the recording material by the recycling method according to the present invention.

According to the present invention, there is provided a method of recycling a recording material which comprises at least a surface portion which swells in contact with water and bears deposited images comprising a thermoplastic or thermofusible material.

This recycling method comprises the steps of (a) applying a water-containing image removal promoting liquid to the image-deposited surface portion of the recording material, (b) brining an image release member into contact with the image-deposited surface portion of the recording material to transfer the images to the image release member to remove the images from the image-deposited recording material, and (c) applying heat to the image-deposited recording material to weaken the adhesion of the images to the surface portion of the recording material at least after the above-mentioned step (a), with retaining the water component of the water-containing image removal promoting liquid in the image-deposited surface portion.

To be specific, when the heating step is carried out in the recycling process of the present invention, the image-deposited surface portion of the recording material to which the image removal promoting liquid has been applied is in a sealed condition, for example, sealed by a sealing member through which the water component of the image removal promoting liquid is not allowed to penetrate.

The conventional recycling method as disclosed in Japanese Laid-Open Patent Application 5-202557 is carried out by causing the image removal promoting liquid to be held on the image-deposited recording material, as previously mentioned. The principle of image removal from the recording material by the above-mentioned conventional recycling method has not been completely clarified. In the case where a sheet of paper is employed as the recording material, it is supposed that when the image-deposited surface portion of the paper is impregnated with the image removal promoting liquid by coating or dipping, the image removal promoting liquid penetrates through the cellulose fibers and the void portions formed in the paper layer by the capillarity, and reaches the contact portion between the image-constituting material and the cellulose fibers. The cellulose fibers are deformed by the swelling effect when absorbing the water component of the image removal promoting liquid. As a result, the contact area between the image-constituting material and the cellulose fibers is decreased by the deviation stress generated between the image-constituting material and the cellulose fibers, thereby extremely lowering the adhesion between the image-constituting material and the cellulose fibers.

In the above-mentioned conventional method, however, it is required that the paper layer of the recording material be impregnated with the image removal promoting liquid in a relatively large amount, namely, in such an amount as to substantially saturate the paper layer of the recording material in order to completely remove the images from the recording material. Depending on the kind of image-constituting material, the images cannot be removed from the paper layer of the recording material to a practical level even by supplying the image removal promoting liquid to the paper layer until the paper layer is saturated.

In contrast to this, according to the present invention, the adhesion between the image-constituting material and the surface portion of the recording material can be readily decreased even when a small amount of image removal promoting liquid is provided to the surface portion of the recording material. This effect can be obtained by the heating step, which is carried out with the image-deposited surface portion of the recording material being in a sealed condition to prevent the water component of the water-containing image removal promoting liquid retained in the surface portion of the recording material from evaporating and being exhaled therefrom. Therefore, the problems caused by the application of a large quantity of the image removal promoting liquid in the conventional method can be solved. The advantages of the recycling method according to the present invention are that the image removal can be achieved by a small amount of image removal promoting liquid, and the limitations in selecting the kind of recording material and the kind of image-constituting material can be moderated.

It is remarkably important that the image removal promoting liquid penetrate to the contact person between the image-constituting material and the recording material in order to sufficiently weaken the adhesion between the image-constituting material and the surface portion of the recording material. For example, the adhesion of the image-constituting material to the recording material hardly decreases when the image removal promoting liquid is applied only to the back side of the recording material, that is, opposite to the image-deposited side of the recording material. In the case where the recording material is impregnated with the image removal promoting liquid simply by the action of wetting, the image removal promoting liquid does not always reach the contact portion between the image-constituting material or other portions adjacent to the above-mentioned contact portion. The reason for this is that the image-constituting material is generally hydrophobic, so that the water-containing image removal promoting liquid is prevented from penetrating to the recording material by the hydrophobic image-constituting material. In particular, when the amount of the image removal promoting liquid is small, it is very difficult that the image removal promoting liquid reach the contact portion of the image-constituting material and the recording material even when the image removal promoting liquid is applied to the image-deposited side of the recording material.

In the recycling method of the present invention, it is supposed that the image removal promoting liquid can fully reach the contact portion between the image-constituting material and the recording material by heating the image-deposited recording material, with the image-deposited surface portion of the recording material being in a sealed condition to prevent the water component of the water-containing image removal promoting liquid from vaporizing and escaping therefrom. Under such a sealed condition of the image-deposited surface portion, the water component contained in the image removal promoting liquid can be efficiently retained in the surface portion in such a fashion that it is absorbed by the recording material, caused to evaporate, and again absorbed thereby. Because of such a repeated cycle, the adhesion of the image-constituting material to the recording material can sufficiently be reduced by a small amount of image removal promoting liquid.

Further, it is possible to retain the water content of the image removal promoting liquid in the image-deposited surface of the recording material with high density by heating the image-deposited surface of the recording material to a relatively low temperature and the back side of the recording material to a relatively high temperature. By such a heating method, the images deposited on the recording material can be efficiently removed therefrom a small amount of image removal promoting liquid. This point will be explained in detail later.

In the conventional recycling method as illustrated in FIG. 1, the adhesion of the image-constituting material to the recording material 15 is caused to pass through the nip between the image release roller 5 and the heat-application roller 8 because the thermal energy is applied to the image-deposited recording material 15 by the heat application roller 8. In this case, however, the image removal promoting liquid 7 retained in the image-deposited surface of the recording material 15 is caused to evaporate by the application of heat thereto because the image-deposited surface portion of the recording material 15 holding the image removal promoting liquid 7 thereon is not in a sealed condition. Even though the image-deposited recording material 15 is transported at slow speed to take an adequate heating time by the heat-application roller 8, the images deposited on the recording material 15 cannot efficiently be removed therefrom by a small amount of image removal promoting liquid 7.

According to the recycling method of the present invention, the image-deposited surface portion of the recording material which holds the image removal promoting liquid thereon may be heated under the previously mentioned sealed condition before the image-deposited surface portion of the recording material is brought into contact with an image release member to facilitate the image removal. Alternatively, while the image-deposited surface portion of the recording material is brought into contact with an image release member, the heating step may be carried out, with the image-deposited surface portion of the recording material being in a sealed condition to prevent the water component of the image removal promoting liquid from vaporizing and escaping therefrom.

In the recycling method of the present invention, it is preferable that the heating step be carried out in such a manner that the image-deposited surface portion of the recording material is heated to a softening or fusing point of the image-constituting material, with the image-deposited surface portion of the recording material being in a sealed condition, before the image-constituting material is caused to be attached and transferred to the image release member.

In the case where the heating step is carried out before image transfer in such a manner that the image-constituting material is heated to a softening or fusing point, as mentioned above, it is possible to decrease the temperature at which the recording material or the image release member is heated. In other words, since the image-deposited surface portion of the recording material is in a sealed condition, the image-constituting material can be heated slowly, for example, by passing along a long heating path, until the temperature of the image-constituting material is almost equal to the temperature of the heat-application means. As a result, the degree of heat resistance required for the image release member can be moderated, and the safety is increased. Another advantage is that the image removal treatment can be made under the same conditions even though the recording materials which show different heat capacities due to different thickness or different coating amount of the image removal promoting liquid are subjected to this recycling process.

In the conventional recycling method as previously mentioned in FIG. 1, if the image-constituting material deposited on the recording material 15 is heated to substantially the same temperature as the temperature of the heat-application roller 8 by causing the image-bearing recording material 15 to slowly pass the nip between the image release member 5 and the heat-application roller 8, the evaporation of a water content of the image removal promoting liquid held on the surface portion of the recording material 15 proceeds. As a result, image removal from the recording material 15 is made difficult.

The recording material for use in the present invention comprises at least a surface portion capable of swelling in water, on which images comprising an image-constituting material such as a thermoplastic or thermofusible material is deposited. For example, there are used as the recording materials for use in the present invention a recording paper for general use, comprising a surface layer mainly comprising cellulose fibers; a laminated material of a plastic film and a paper layer capable of bearing thereon deposited images; and a recording material comprising a surface layer capable of swelling in an image removal promoting liquid to be employed, as previously proposed. Particularly, commercially available recording papers with a thickness of about 20 to 200 μm are preferably subjected to the recycling method of the present invention from the availability and cost.

The image release member for use in the present invention is a member which is brought into contact with the image-constituting material deposited on the recording material and released from the recording material to peel the image-constituting material from the recording material. Therefore, it is required that the contact portion of the image release member with the image-constituting material comprises a material capable of showing the adhesion to the image-constituting material and the heat-resistance to a certain extent.

Examples of such a material for use in the image release member include synthetic rubbers such as a isoprene rubber, neoprene rubber, chloroprene rubber, silicone rubber, butadiene rubber, and fluorine-contained rubber; natural rubbers; epoxy resins such as bisphenol-epichlorohydrin condensation product; amino resins such as alkyd resin, urea-formaldehyde resin, butylurea-formaldehyde resin, butylated melamine-formaldehyde resin, and benzoguanamine formaldehyde resin; heat-hardening phenolic resins such as terpenephenolic resin, phenol ether resin, and phenolic resin; vinyl copolymers such as polyvinyl chloride, polyvinylidene chloride, vinylidene chloride-acrylonitrile copolymer, vinyl chloride-vinyl acetate copolymer, ethylene-vinyl acetate copolymer, ethylene-tetrafluoroethylene copolymer, and polyvinylidene fluoride; vinyl polymers such as polyvinyl butyral, polyvinyl formal, polypropylene, and polyethylene; acrylic resins such as polybutyl acrylate, polymethacrylic acid, and polymethyl methacrylate; polyamides such as polyimide, 6,6-nylon, and 6-nylon; polyesters such as polycarbonate, polyether sulfone, polyether ether ketone, polyethylene terephthalate, polyethylene naphthalate, and aromatic polyester; thermoplastic or thermosetting synthetic resins such as polyphenylene sulfide, polyether nitrile, and aramid; metals and metallic oxides such as nickel, stainless steel, and aluminum; and ceramic materials.

It is important that the material for use in the image release member be selected depending on the kind of image-constituting material to be peeled from the recording material, and the image removal process to be employed. In the present invention, repeated use of the image release member is advantageous from the viewpoint of cost required for the recycling process. Therefore, the material with relatively high resistance and surface stability is preferably employed for the image release member. From the aspects of the image peeling properties and durability of the image release member, the following materials are particularly preferred: polyethylene terephthalate, polyethylene naphthalate, polyether ether ketone, polyphenylene sulfide, polyether nitrile, aramid, polyimide, polyetherimide, stainless steel, nickel, and anodized aluminum.

The above-mentioned materials may be used alone or in combination to form a laminate, an alloy, or a composite by the addition of other additives such as glass fiber, whisker, carbon, silica and titanium oxide.

It is not always necessary that the image release member be brought into contact with the entire surface of the image-deposited recording material while the images are caused to be transferred from the recording material to the image release member. The image release member may be partially provided with a material suitable for image peeling corresponding to the image portion on the recording material.

The image release member may be in the form of a sheet, belt, block, drum or roller.

The image removal promoting liquid for use in the present invention comprises water. In the present invention, the image removal promoting liquid may be supplied to the same image-deposited recording material by multiple steps. In such a case, it is not always necessary to use the water-containing image removal promoting liquid every time, but the water-containing image removal promoting liquid is applied to the recording material at least on time.

The image removal promoting liquid for use in the present invention may comprise a surfactant, a water-soluble polymer, and a water-soluble organic compound.

The surfactant serves to allow the image removal promoting liquid to quickly penetrate through the surface portion of the recording material. The static surface tension of the image removal promoting liquid may be controlled to 50 mN/m or less by the addition of the surfactant because the wettability of the surface portion of the recording material and the image-constituting material by the image removal promoting liquid is increased. Thus, the penetrating speed of the image removal promoting liquid through the surface portion of the recording material is accelerated, so that high speed recycling process can be achieved and the apparatus for recycling the recording material can be decreased in size. To cope with the high speed recycling process, the dynamic surface tension of the image removal promoting liquid may also be controlled to 50 mN/m or less, which can be measured by vibrating jet method, drop weight method or bubble pressure method.

Examples of the surfactant for use in the image removal promoting liquid include anionic surfactants, cationic surfactants, nonionic surfactants and ampholytic surfactants.

Specific examples of the nonionic surfactant are polyoxyethylene alkyl ether, polyoxyethylene alkylphenyl ether, polyoxyethylene alkyl ester, polyoxyethylene alkylsorbitan ester, polyoxyethylene alkylamine, glycerin fatty acid ester, decaglycerin fatty acid ester, polyglycerin fatty acid ester, sorbitan fatty acid ester, propylene glycol fatty acid ester, polyethylene glycol fatty acid ester, polyoxyethylene polyoxypropylene alkyl ether, polyoxyethylene polyoxypropylene block polymer, perfluoroalkylphosphoric ester, and polyoxyethylene-modified polydimethylsiloxane.

Specific examples of the anionic surfactant are high fatty acid salt, N-acylamino acid salt, polyoxyethylene alkyl ether carboxylate, acylated peptide, alkyl sulfonate, alkylbenzenesulfonate, alkylnaphthalenesulfonate, monoalkylsulfosuccinate, dialkylsulfosuccinate, α-olefinsulfonate, N-acylsulfonate, alkylsulfate, polyoxyethylene alkyl ether sulfate, polyoxyethylene alkylaryl ether sulfate, alkylamide sulfate, monoalkyl phosphate, dialkyl phosphate, trialkyl phosphate, monopolyoxyethylene alkyl ether phosphate, bispolyoxyethylene alkyl ether phosphate, trispolyoxyethylene alkyl ether phosphate, polyoxyethylene alkylaryl ether phosphate, perfluoroalkyl carboxylate, perfluoroalkyl sulfonate, perfluoroalkenylaryl sulfonate, N-perfluorooctanesulfonyl glutamate, perfluoroalkyl-N-ethylsulfonylglycine salt, 3-(ω-fluoroalkanoyl-N-ethylamino)-1-propanesulfonate, perfluoroalkylethyl phosphoric ester salt, carboxylic-acid-modified polydimethylsiloxane, and sulfonic-acid-modified polydimethylsiloxane.

Specific examples of the cationic surfactant are high alkylamine salt, higher alkyl quaternary ammonium salt, alkylbenzene amine salt, alkylbenzene quaternary ammonium salt, and alkyl heterocyclic quaternary ammonium salt.

Examples of the amphoteric surfactant are betaine and aminocarboxylic acid.

When one kind of image removal promoting liquid is supplied to the image-deposited surface portion of the recording material, or the application of the image removal promoting liquid is carried out by one step, it is preferable that the amount of the surfactant for use in the image removal promoting liquid be in a range of 0.05 to 20 wt. %, or more preferably in a range of 0.1 to 2 wt. %, of the total weight of the image removal promoting liquid. When the amount of the surfactant is within the above range, the penetrating speed of the image removal promoting liquid is sufficiently quick, the drying process of the recording material can be facilitated after image removal, and the recording properties of the recycled recording material are not lowered.

As previously mentioned, the image removal promoting liquid may be provided to the image-deposited surface portion of the recording material by multiple steps. For instance, it is preferable to apply a first image removal promoting liquid containing a surfactant in an amount of 5 to 100 wt. % to the image-deposited surface portion which a coating amount of about 20 to 600 $\mu g/cm^2$by the first step, and a second image removal promoting liquid comprising water as the main component and a surfactant in an amount of 0.5 wt. % or less to the image-deposited surface portion. The difference between the absorption amount of the image removal promoting liquid in the image portion and that in the background portion of the recording material can be compensated by the above-mentioned application method, and the image can be removed from the recording material by the application of a small amount of image removal promoting liquid.

The application of the image removal promoting liquid to the image-deposited recording material may be carried out by multiple steps as occasion requires. In the case where the image removal promoting liquid is applied to the recording material little by little, the images can be removed from the recording material efficiently even though the total amount of image removal promoting liquid applied to the recording material is small per unit area. However, the more the steps of applying the image removal promoting liquid to the recording material, the more complicated the structure of the apparatus for recycling the image-deposited recording material.

It is preferable that the image removal promoting liquid for use in the present invention comprises a water-soluble polymer. The water-soluble polymer can promote the adhesive force of the image-constituting material to the image release member. In addition, the stiffness of the recycled recording material can be improved by the water-soluble polymer used in the image removal promoting liquid after the images are peeled from the recording material. Namely, the quality of the recycled recording material can be improved.

Specific examples of the water-soluble polymer for use in the image removal promoting liquid are as follows: carboxymethyl cellulose, polyvinyl alcohol, starch, alginate, gum arabic, gelatin, polyacrylate, polymethacrylate, salts of hydrolyzed compounds of styrene-maleic anhydride copolymer, salts of hydrolyzed compounds of styrene-osobutylene-phthalimide copolymer, hyaluronic acid, gelan gum, condensate of naphthalenesulfonic acid and formalin, polyvinylarylsulfonate, water-soluble polyamide, hydroxyethyl cellulose, polyvinyl pyrrolidone, and polyacrylamide.

Furthermore, it is not always necessary that the image removal promoting liquid comprise a surfactant in order to improve the wettability of the surface portion of the recording material and the image-constituting material by the image removal promoting liquid. For instance, the same effect as obtained by the addition of the surfactant can be gained when the image removal promoting liquid comprises a water-soluble organic compound, for example, alcohols such as methanol and ethanol, acetone, carbitol and sorbitol.

Specific examples of other water-soluble organic compounds for use in the image removal promoting liquid include polyhydroxy alcohols such as ethylene glycol, diethylene glycol, triethylene glycol, tetraethylene glycol, polyethylene glycol, propylene glycol, dipropylene glycol, glycerin, and 1,5-pentanediol; heterocyclic compounds such as N-methyl-2- pyrrolidone, 1,3-dimethylimidazolidinone, and ε-caprolactam; and amines such as monoethanolamine, diethanolamine, triethanolamine, monoethylamine, diethylamine, and triethylamine.

Those water-soluble organic compounds can prevent the image removal promoting liquid from being evaporated to dryness and deposited to the surface of various members in the recycling apparatus, prevent the physical properties of the image removal promoting liquid from being changed, and promote the peeling properties of the image-constituting material from the recording material.

From the viewpoint of improvement in shelf stability of the image removal promoting liquid, it is preferable to add antiseptic agents such as dehydroacetate, sorbate, benzoate, and pentachlorophenol.

According to the recycling method of the present invention, when the image-deposited recording material is heated at the heating step, the image-deposited recording material is in a sealed condition to prevent the water component of the water-containing image removal promoting liquid from vaporizing and escaping therefrom. For instance, it is preferable to use a sealing member which comprises at least one portion through which the water component of the image removal promoting liquid is not allowed to penetrate. The water component includes water in the form of liquid and water vapor in the form of gas.

FIGS. 2(*a*) through 2(*h*) and 3(*a*) and 3(*b*) are schematic views which show the sealed condition of the image-deposited recording material.

As shown in FIG. 2(*a*), image constituting materials 22 deposited on a recording material 21 are brought into contact with an image release member 23, and the image-deposited recording material 21 and the image release member 23 are tightly sealed in a sealing member 24. The image removal can be achieved satisfactorily by causing the image-deposited recording material to pass through a nip between a heat-application roller and a pressure-application roller under such a condition as shown in FIG. 2(*a*).

FIG. 2(*b*) shows one embodiment in which an image release member 25 serves as a sealing member. The image release member 25 which comprises a material through which the water content is not allowed to penetrate is brought into contact with image-constituting materials 22 deposited on a recording material 21. The image-deposited recording material 21 is tightly sealed in the image release member 25 which also serves as a sealing member. As a result, the image release member 25 can prevent the escape of the water component of the image removal promoting liquid from the surface portion of the recording material, so that the image removal from the recording material 21 can be facilitated, and the structure of the apparatus can be made simple.

The water content is not allowed to penetrate through any of the previously mentioned materials for use in the image release member, so that such an image release member can function as a sealing member.

As shown in FIG. 2(*c*), image-constituting materials 22 deposited on a recording material 21 are brought into contact with an image release member 23, and the image-deposited recording material 21 and the image release member 23 are closely interposed between a pair of sheet-shaped sealing members 26*a* and 26*b* . The width of the sealing members 26*a* and 26*b* is wider than that of the recording material 21 as shown in FIG. 2(*c*), so that the diffusion of water vapor can be prevented. In this case, the sealing members 26*a* and 26*b* may be freely detached to repeatedly use those sealing members 26*a* and 26*b*. The material for the sealing members 26*a* and 26*b* and that for the image release member 23 may be the same or different. The escape of the water component can be prevented more effectively by making the length of the sealing members 26*a* and 26*b* longer than that of the recording material 21. The sealing member 26*a* and the image release member 23 may be independently formed, or integrally molded.

In FIG. 2(*d*), an image release member 23 is brought into contact with a recording material 21 on which image-constituting materials 22 are deposited. The image release member 23 and the image-deposited recording material 21 are interposed between a pair of sealing members 26*a* and 26*b* similarly to the case of FIG. 2(*c*). In this embodiment, the sealing member 26*a* is attached to the sealing member 26*b* with a pressure-sensitive adhesive 27 at both ends of the sealing members 26*a* and 26*b* in the transporting direction thereof, that is, the length direction thereof. In such a case, the escape of the water component can be prevented even when the width of the sealing members 26*a* and 26*b* is not so wider than that of the recording material 21. The material for the sealing members 26*a* and 26*b* and that for the image release member 23 may be the same or different. The escape of the water component can be prevented more effectively by making the length of the sealing members 26*a* and 26*b* longer than that of the recording material 21.

For a resin component for use in the pressure-sensitive adhesive 27, protein-based resins such as glue, gelatin, albumin and casein; carbohydrate-based resins such as starch, cellulose, and composite polysaccharides including gum arabic and gum tragacanth; thermoplastic resins such as polymers and copolymers of vinyl acetate, acrylics, ethylenic copolymer, polyamide, polyester, and polyurethane; and rubbers such as polychloroprene rubber, nitrile rubber, reclaimed rubber, styrene-butadiene rubber (SBR), and natural rubber. For instance, a double-coated adhesive tape may be prepared by providing a rubber- or acrylic-based pressure-sensitive adhesive layer on a support member of cellophane tape, adhesive craft-paper tape, polyvinyl chloride tape, acetate tape, or filament-reinforced tape.

In the embodiment as shown in FIG. 2(*e*), an image release member 28 which also serves as a sealing member is brought into contact with the surface portion of a recording material 21 on which image-constituting materials 22 are imagewise deposited. The width of the image release member 28 is made wider than that of the recording material 21 as shown in FIG. 2(*e*). The image release member 28 can be freely attached to a sealing member 26*b* or detached therefrom by providing a pressure-sensitive adhesive 27 between the image release member 28 and the sealing member 26*b* at both ends in the transporting direction of the recording material 21, that is, the length direction thereof.

The embodiment of FIG. 2(*f*) is the same as that of FIG. 2(*e*) except that the image release member 28 serving as a sealing member is attached to the sealing member 26*b* at both ends thereof not using a pressure-sensitive adhesive. This configuration is preferable because the structure of the apparatus can be simplified.

In FIG. 2(*g*), a recording material 211 comprises a layer 211*a* through which a water content is not allowed to penetrate, and layers 211*b* and 211*c* capable of swelling in contact with an image removal promoting liquid to be employed, which are provided on both sides of the layer 211*a*. Image-constituting materials 22 are imagewise deposited on the layer 211*b* of the recording material 211, and an image release member 23 is brought into contact with the image-deposited layer 211*b* of the recording material 211 functions as a sealing member, so that it is considered that the image release member 23 and the image-deposited recording material 211 are closely sealed by a sealing member 26*a* and the layer 211*a* of the recording material 211.

In the embodiment as shown in FIG. 2*h*), a recording material 211 comprises a layer 211*a* through which a water content is not allowed to penetrate, and layers 211*b* and 211*c* capable of swelling in contact with an image removal promoting liquid to be employed, which are provided on both sides of the layer 211*a*. Image-constituting materials 22 are imagewise deposited on the layer 211*b* of the recording material 211, and an image release member 28 which also serves as a sealing member is brought into contact with the image-deposited layer 211*b* of the recording material 211. In this embodiment, both the layer 211*a* of the recording material 211 and the image release member function as sealing members to prevent the water component of an image removal promoting liquid from vaporizing and escaping from the layer 211*b* of the recording material 211.

In the embodiment as shown in FIGS. 2(*g*) and 2(*h*), the recording material 211 is a special material, for example, prepared by providing paper layers on both sides of a plastic film serving as a base material. Although those embodiments have the drawback that it is difficult to remove the images deposited on the end portion of the recording material, the embodiment of FIG. 2(*h*) is particularly advantageous because it is not necessary to prepare a sealing member, thereby facilitating the recycling process and simplifying the recycling apparatus.

Figure 3A:
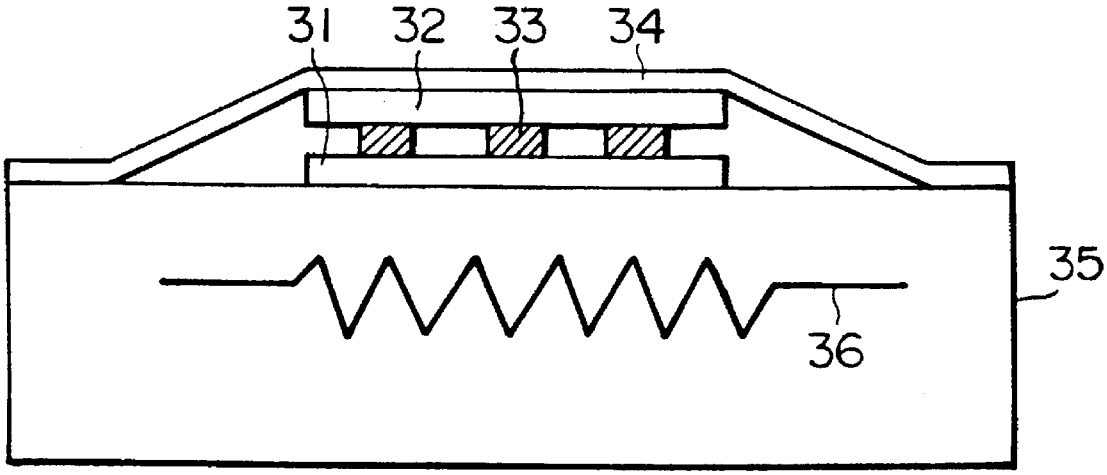
FIGS. 3(*a*) and 3(*b*) are schematic cross-sectional views showing the examples of the recycling method according to the present invention, in which a image-deposited recording material is sealed by a sealing member having a heater therein.
Figure 3B:
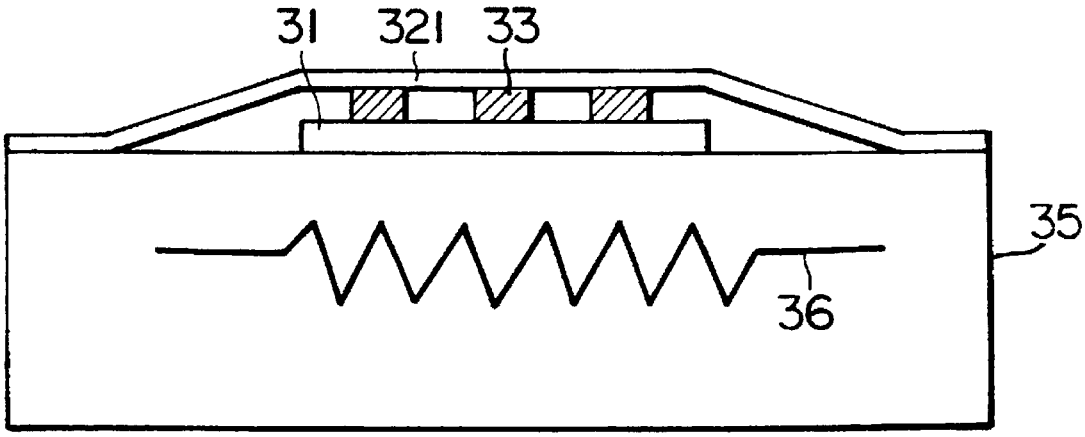

In the embodiment as shown in FIG. 3(*a*), image-constituting materials 33 are imagewise deposited on a recording material 31, and an image release member 32 is brought into contact with the image-deposited recording material 31. The image release member 32 and the image-deposited recording material 31 are interposed between a sealing member 34 in the form of a sheet and a sealing member 35 in the form of a block having a heater 36 therein. The sealing member 35 serves as both a sealing member and a heat-application member for the image-deposited recording material 31. Thus, the image-deposited recording material 31 can be heated by the heater 36 in a sealed condition. As shown in FIG. 3(*a*), the sealing member may be in the form of a sheet, belt, block, drum or roller.

As shown in FIG. 3(*b*), an image release member 321 comprises a material through which the water content is not allowed to penetrate, so that the image release member 321 can also function as a sealing member. This structure can make a recycling apparatus simple.

In order to simplify the recycling apparatus of the present invention, as previously mentioned, it is advantageous that at least one member selected from the group consisting of an image release member, a heat-application member for the image-deposited recording material, a heat-application member for the image-constituting material deposited on the recording material, a heat-application member for the image release member, a pressure-application member for the image-deposited recording material and the image release member, a transporting member for the image-deposited recording material, and a transporting member for the image release member comprise at least a portion comprising a material through which water content is not allowed to penetrate, and be disposed so as to serve as a sealing member to substantially prevent the water component of the image removal promoting liquid from evaporating and escaping from the surface portion of the recording material Other features of this invention will become apparent in the course of the following description of exemplary embodiments, which are given for illustration of the invention and are not intended to be limiting thereof.

EXAMPLE 1

Toner images were formed on a commercially available high quality paper, using a commercially available copying machine (Trademark "IMAGIO 320 FP1", made by Ricoh Company, Ltd.). An image removal promoting liquid with the following formulation was applied to the image-deposited surface of the paper with a coating amount of 2.9 mg/cm$^2$, that is, 1.8 g/A4 size.

| | wt. % |
|---|---|
| Polyoxyethylene alkyl ether based surfactant | 0.2 |
| Dodecylbenzenesulfonic acid | 1.0 |
| Alginic acid | 0.3 |
| Sodium fluoroalkylcarboxylate | 0.9 |
| Potassium dehydroacetate | 0.3 |
| Water | 97.3 |

Immediately after the application of the image removal promoting liquid to the image-deposited paper, the paper was placed in a polyethylene terephthalate bag with a thickness of 16 μm and the bag was tightly sealed by heat sealing. Then, the image-deposited paper sealed in the polyethylene terephthalate bag was heated in a temperature controlled bath of 95° C. for 10 minutes, without the application of pressure to the paper and the polyethylene terephthalate bag. The bag was taken out of the temperature controlled bath and cooled to room temperature. Then, the image-deposited paper was taken out of the polyethylene terephthalate bag, and a commercially available pressure-sensitive adhesive tape was immediately brought into pressure contact with the image-deposited surface of the paper and peeled from the paper before the water content retained in the image-deposited surface of the paper was evaporated. As a result, the images were transferred to the adhesive tape and removed from the paper at an image peeling ratio of about 85%.

To obtain the image peeling ratio, the total image area originally formed in the paper and the total image area in the paper after the recycling process were measured by using a scanner. Then, the image peeling ratio was calculated in accordance with the following formula:

$$\text{Image Peeling Ratio}(\%) = \left(1 - \frac{\text{Image area after recycling process}}{\text{Image area originally formed}}\right) \times 100$$

EXAMPLE 2

Toner images were formed on a commercially available high quality paper, using a commercially available copying machine (Trademark "IMAGIO 320 FP1", made by Ricoh Company, Ltd.). The same image removal promoting liquid as used in Example 1 was applied to the image-deposited surface of the paper with a coating amount of 2.9 mg/cm$^2$, that is, 1.8 g/A4 size.

After the application of the image removal promoting liquid to the image-deposited paper, a 50-μm-thick polyethylene naphthalate film with the same size as that of the image-deposited high quality paper, serving as an image release member, was brought into contact with the image-deposited surface of the paper.

Two 75-μm-thick polyimide films, each having a width 20 mm wider and a length 50 mm longer as compared with the high quality paper and the polyethylene naphthalate film, were formed in a bag by attaching the one film to the other at both ends in the width direction and one end in the length direction of films by use of a double-coated adhesive tape.

With the polyethylene naphthalate film serving as the image release member being in contact with the image-deposited surface of the paper which was impregnated with the image removal promoting liquid, such a laminated material of the polyethylene naphthalate film and the image-deposited paper was quickly sealed in the polyimide film bag serving as a sealing member through which the water content of the image removal promoting liquid was not allowed to penetrate.

Figure 4:
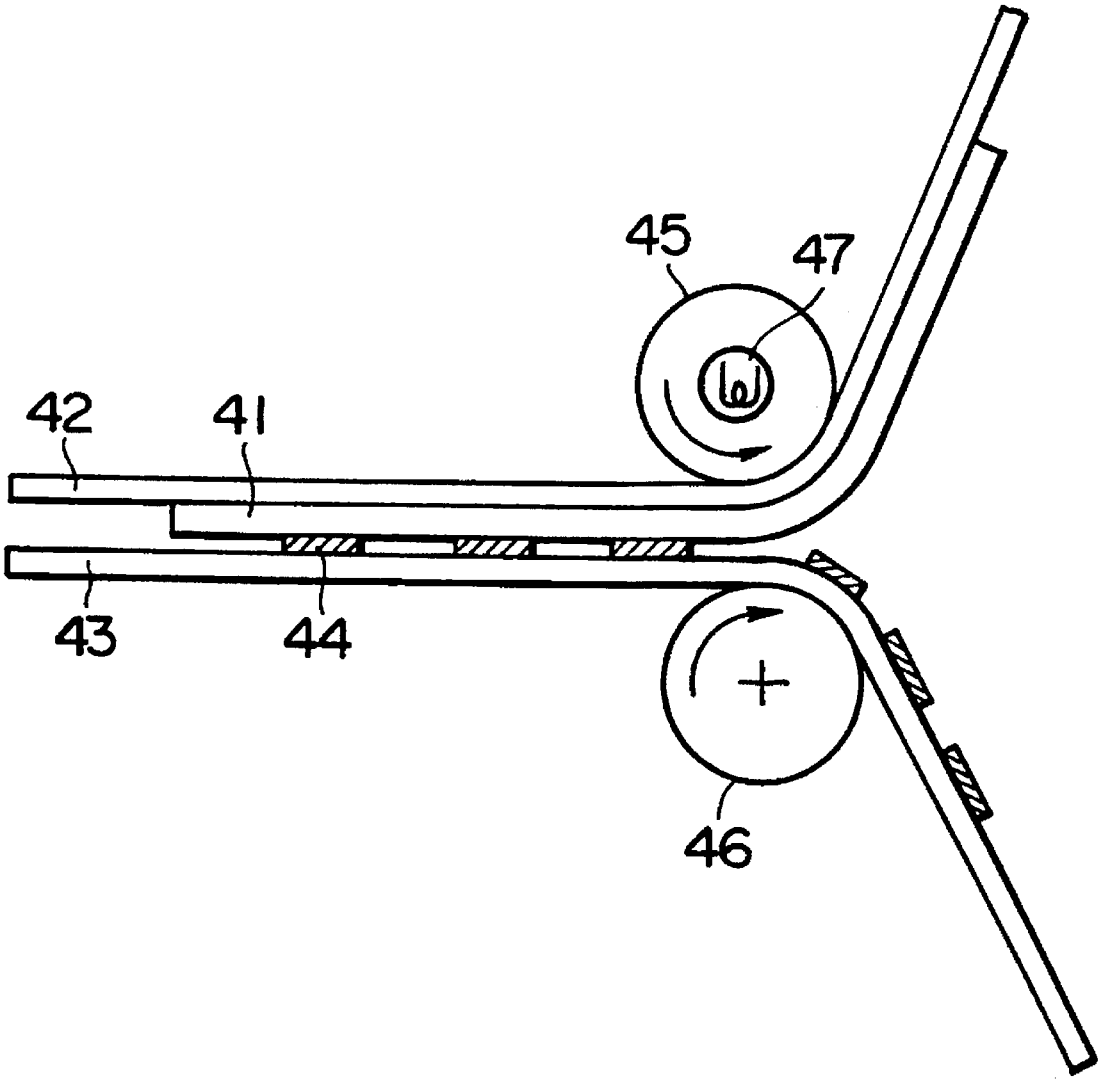
FIG. 4 is a schematic view which shows the structure of an image transfer unit of an apparatus for recycling the image-deposited recording material used in Example 3.

Using an apparatus as shown in FIG. 4, the laminated material of the image release member and the image-deposited paper, which was sealed in the polyimide film bag, was caused to pass through a nip between a heat- and pressure-application roller 45 with a surface temperature of 110° C. and a pressure-application roller 46, with the linear speed of the heat- and pressure-application roller 45 being controlled to 5 mm/sec.

Thereafter, the laminated material sealed in the polyimide film bag was put on a hot plate of 98° C. Thus, the image-deposited paper was subjected to heat treatment for 20 seconds, with the opening of the polyimide film bag being sealed by using a flat-shaped weight made of steel to ensure the sealed condition of the image-deposited paper.

The image release member was separated from the paper on the hot plate so as not to cool the images. As a result, all the images deposited on the high quality paper were completely transferred to the image release member. The thus obtained image-free high quality paper was dried to be ready for the next copying process.

In FIG. 4, the heat- and pressure-application roller 45 is a Teflon-coated aluminum roller, having a halogen lamp 47 therein, and the pressure-application roller 46 is an aluminum roller having a surface layer made of a silicone rubber. The pressure- and heat-application roller 45 and the pressure-application roller 46 are urged to each other under the application of pressure thereto by use of a spring not shown in FIG. 4.

According to the recycling method employed in Example 2, when the image-deposited surface portion of a recording material is brought into pressure contact with an image release member by passing through a nip between the heat- and pressure-application roller and the pressure-application roller, adhesion is generated between the image-constituting material and the image release member. Thereafter, in order to weaken the adhesion between the image-constituting material and the surface portion of the recording material, a laminated material of the image-deposited recording material and the image release member, which is in a sealed condition to prevent the escape of the water-component of the image removal promoting liquid from the image-deposited surface portion of the recording material, is further heated, without the application of pressure to the recording material or under the application of a pressure smaller than that previously applied to generate the adhesion between the image-constituting material and the image release member.

Comparative Example 1

Toner images were formed on a commercially available high quality paper, using a commercially available copying machine (Trademark "IMAGIO 320 FP1", made by Ricoh Company, Ltd.). The same image removal promoting liquid as used in Example 1 was applied to the image-deposited surface of the paper with a coating amount of 2.9 mg/cm$^2$, that is, 1.8 g/A4 size.

After the application of the image removal promoting liquid to the image-deposited paper, a 50-μm-thick polyethylene naphthalate film with the same size as that of the image-deposited high quality paper, serving as an image release member, was brought into contact with the image-deposited surface of the high quality paper.

Using the apparatus as shown in FIG. 4, the thus prepared laminated material of the image release member and the image-deposited high quality paper was caused to pass through a nip between the heat- and pressure-application roller 45 with a surface temperature of 110° C. and a pressure-application roller 46, with the linear speed of the heat- and pressure-application roller being controlled to 5 mm/sec.

Immediately after that, the high quality paper was separated from the image release member with the hand.

As a result, the images deposited on the high quality paper were removed therefrom at an image peeling ration of about 40%. It was impossible to use the thus obtained paper as a copy paper again.

Then, the same recycling process as mentioned above was repeated with the surface temperature of the heat- and pressure-application roller 45 being changed in a range of 70° to 150° C. In any case, the image peeling ratio was as low as 42% or less, and a part of the surface portion of the paper corresponding to an image area was peeled off and transferred to the image release member.

EXAMPLE 3

Toner images were formed on a commercially available high quality paper, using a commercially available copying machine (Trademark "IMAGIO 320 FP1", made by Ricoh Company, Ltd.). The same image removal promoting liquid as used in Example 1 was applied to the image-deposited surface of the paper with a coating amount of 2.9 mg/cm$^2$, that is, 1.8 g/A4 size.

Immediately after the application of the image removal promoting liquid to the image-deposited paper, the image-deposited paper was interposed between two 75-μm-thick polyethylene terephthalate (PET) films larger than the image-deposited paper by 30 mm both in the width direction and the length direction, and put on a hot plate of 98° C. with the back side of the paper, opposite to the image-deposited side, being directed to the hot plate. Thus, the image-deposited paper was subjected to heat treatment for 20 seconds, with a stainless steel frame which was somewhat smaller than the PET films being put on the films to that the peripherals of the PET films might be pressed to effectively retain the water component in the image-deposited surface portion of the paper.

The image-deposited paper held between the two PET films was removed from the hot plate as it was, and cooled to room temperature. Thereafter, using an apparatus as shown in FIG. 4, the paper 41 on which images 44 were deposited, held between the one polyethylene terephthalate film 42 serving as a sealing member and the other polyethylene terephthalate film 43 serving as both an image release member and a sealing member, was caused to pass through a nip between a heat- and pressure-application roller 45 with a surface temperature of 135° C. and a pressure-application roller 46, with the linear speed of the heat- and pressure-application roller 45 being controlled to 20 mm/sec. When the paper 41 was separated from the PET film 43 by the finger, all the images 44 deposited on the paper 41 were completely transferred to the PET film 43. The paper free from the images was dried to get ready for the next copying process.

EXAMPLE 4

Toner images were formed on a commercially available high quality paper with a thickness of 75 μm, using a commercially available copying machine (Trademark "FT2000", made by Ricoh Company, Ltd.). The softening point of the toner was about 80° C. An image removal promoting liquid with the following formulation was applied to the image-deposited surface of the paper with a coating amount of 3.7 mg/cm$^2$, that is, 2.3 g/A4 size.

| | wt. % |
|---|---|
| Polyoxyethylene alkyl ether based surfactant | 0.5 |
| Polyoxyethylene nonylphenyl ether based surfactant | 1.0 |
| Hyaluronic acid | 0.1 |
| Diethylene glycol | 2.5 |
| Potassium benzoate | 0.1 |
| Water | 95.8 |

Figure 5A:
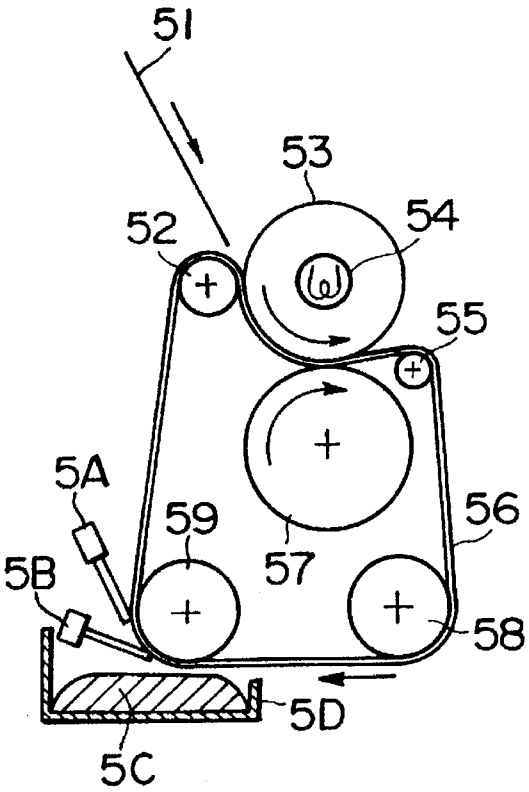
FIG 5(*a*), 5(*b*) and 5(*c*) are schematic views which show the examples of the recycling apparatus according to the present invention, respectively used in Examples 4, 6 and 7.
Figure 5B:
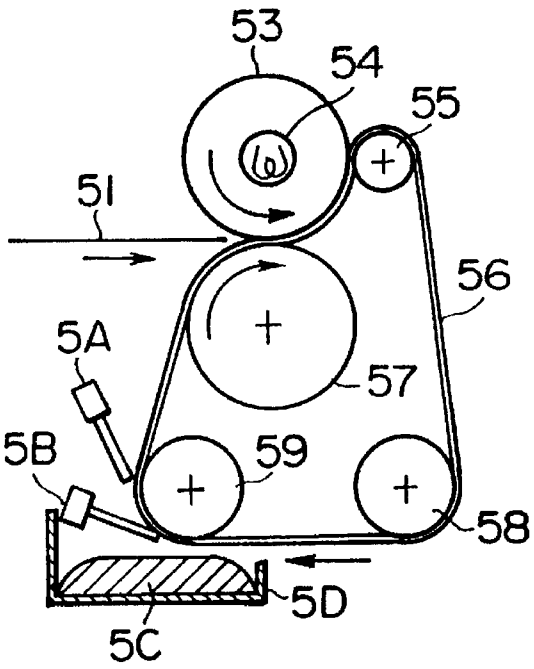
Figure 5C:
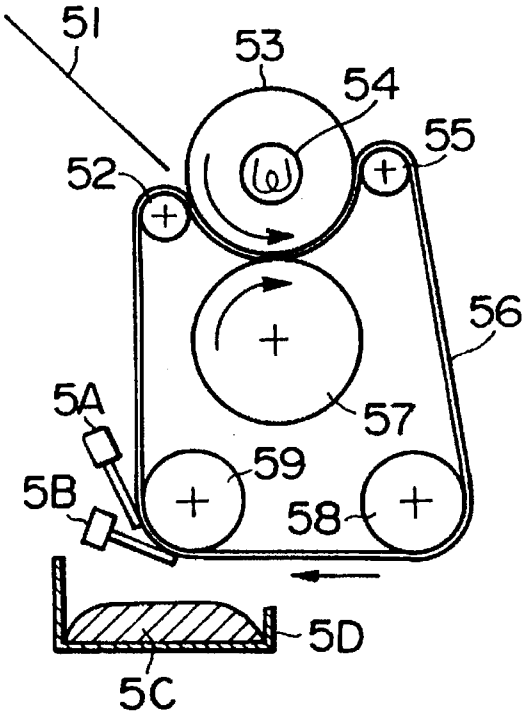

Images deposited on the paper were formed therefrom using an apparatus as shown in FIG. 5(*a*).

After the application of the image removal promoting liquid to the image-deposited paper, the paper 51 was inserted into a gap between an introducing roller 52 and a heat-application drum 53 of the apparatus as shown in FIG. 5(*a*), with the image-deposited surface of the paper 51 being directed to the introducing roller 52. The image-deposited paper 51 was transported with being held between the heat-application drum 52 which was a fluoroplastic-coated aluminum drum through which the water content was not allowed to penetrate and an image release member 56 in the form of an endless belt (hereinafter referred to as an image release endless belt) comprising polyphenylene sulfide resin through which the water content was not allowed to penetrate, with the application of heat from a halogen lamp 54. Then, the image-deposited paper 51 arrived at a nip between the heat-application drum 53 and a pressure-application drum 57 which was surface-treated by silicone rubber coating.

The surface temperature of the heat-application drum 53 was previously set to 95° C. by the halogen lamp 54 included in the drum 53. The image-deposited surface of the paper 51 was heated to about 93° C. when the paper 51 arrived at the nip between the heat-application drum 53 and the pressure-application drum 57. Thus, while the image-deposited paper 51 was caused to pass through the nip between the drums 53 and 57 with the application of heat and pressure to the image-deposited paper 51, the images deposited on the paper 51 were attached or transferred to the surface of the image release endless belt 56. When the paper 51 was separated from the image release endless belt 56 by a separating roller 55, all the images deposited on the paper 51 were completely removed from the paper 51.

As illustrated in FIG. 5(*a*), the image release endless belt 56 is disposed in such a configuration that the introducing roller 52, the separating roller 55 and transporting roller 58 and 59 internally touch the image release endless belt 56. The image release endless belt 56 is moved in the same direction as the rotational direction of the heat-application drum 53 at almost the same speed as the linear speed of the heat-application drum 53 by the friction between the heat-application drum 53 which is driven in rotation by a driving means not shown in the figure and the pressure-application drum 57. The width of the heat-application drum 53 and that of the image release endless belt were made wider than that of the image-deposited paper 51 so as to prevent a water content of the image removal promoting liquid from vaporizing and escaping from the image-deposited paper 51 while the image-deposited paper 51 was transported with being held between the heat-application drum 53 and the image release endless belt 56. In the apparatus as shown in FIG. 5(*a*), the heat-application drum 53 serves as a heat-application member, a transporting member for the image-deposited paper 51, a member for bringing the image-deposited surface of the paper 51 in pressure contact with the image release endless belt 56, and a sealing member for preventing the escape of the water component from the image-deposited paper 51. In addition, the image release endless belt 56 also serves as a sealing member.

The apparatus as shown in FIG. 5(*a*) is provided with a temperature sensor (not shown) to detect the surface temperature of the heat-application drum 53, and the data output by the temperature sensor is input to a temperature control system (not shown). The predetermined surface temperature of the heat-application drum 53 is maintained in such a manner that the data is sent to the halogen lamp 54 in the heat-application drum 53 by the temperature control system.

The heat-application drum 53 and the pressure-application drum 57 are urged to each other by the application of a pressure of about 1 $Kgf/cm^2$ thereto using a pressure-application means (not shown), thereby forming a nip with a width of 1 to 10 mm between the two drums 53 and 57. The image release endless belt 56 is extended in tension by a tension controlling system (not shown). The pressure applied to the heat-application drum 53 by the tension of the image release endless belt 56 is controlled to be smaller than the pressure applied between the heat-application drum 53 and the pressure-application drum 57.

The images transferred to the surface of the image release endless belt 56 are peeled therefrom by using stainless steel blades 5A and 5B, and the image-constituting material 5C is collected in a container 5D. It is not always necessary that the image-constituting material be perfectly removed from the image release endless belt 56 every time one recycling process is carried out.

Comparative Example 2

Figure 6A:
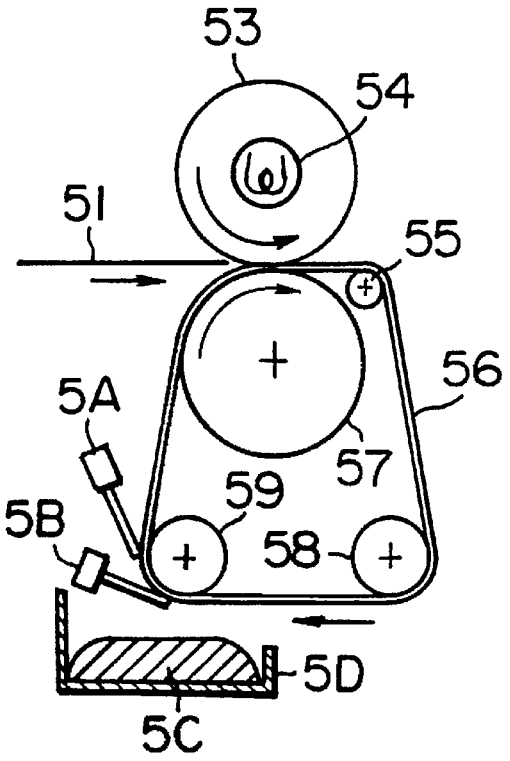
FIGS. 6(*a*) and 6(*b*) are schematic views which show the examples of the conventional recycling apparatus, respectively used in Comparative Examples 2 and 4.
Figure 6B:
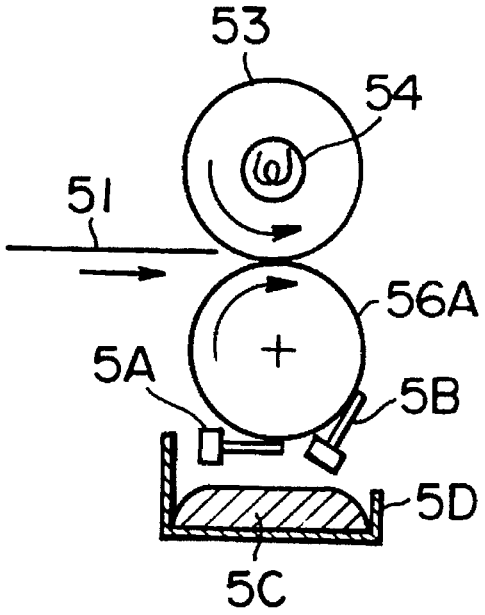

The same recycling process for the image-deposited paper as in Example 4 was repeated except that the apparatus as shown in FIG. 5(*a*) used in Example 4 was replaced by a conventional apparatus as shown in FIG. 6(*a*).

As a result, any images deposited on the paper 51 were not removed therefrom when the surface temperature of the heat-application drum 53 was controlled to 95° C.

Then, the same recycling process as mentioned above was repeated with the surface temperature of the heat-application drum 53 being changed in a range of 70° to 150° C. When the surface temperature of the heat-application drum 53 was controlled to 120° C. or more, images were partially transferred to the surface of the image release endless belt 56. In any case, however, the image peeling ratio was as low as 30% or less, and the surface portion of the paper, corresponding to the image area, was partially peeled off and transferred to the image release endless belt 56.

The conventional apparatus of FIG. 6(*a*) is different from the apparatus of FIG. 5(*a*) in that an introducing roller 52 for introducing an image-deposited recording material into the apparatus is not provided, so that the image release endless belt 56 is not designed to move along the circumference of the heat-application drum 53. Namely, there is no means for preventing the escape of the water component retained in the image-deposited surface portion of the recording material.

The same reference numerals designate identical or corresponding parts throughout FIGS. 5(*a*) to 5(*c*), and 6(*a*) and 6(*b*).

EXAMPLE 5

The same recycling process for the image-deposited paper as in Example 4 was repeated using the apparatus as shown in FIG. 5(*a*) except that the 75-μm-thick high quality paper used in Example 4 was replaced by a high quality paper with a thickness of 150 μm.

As a result, all the images deposited on the paper were completely removed therefrom, and the paper free from images was dried to be ready for the next copying process.

Comparative Example (b 3

The same recycling process for the image-deposited paper as in Comparative Example 2 was repeated using the conventional apparatus as shown in FIG. 6(*a*) except that the 75-μm-thick high quality paper used in Comparative Example 2 was replaced by a high quality paper with a thickness of 150 μm.

As a result, the images deposited on the paper were not removed therefrom satisfactorily.

EXAMPLE 6

The same recycling process for the image-deposited paper as in Example 4 was repeated except that the apparatus of FIG. 5(*a*) used in Example 4 was replaced by an apparatus as shown in FIG. 5(*b*), and the surface temperature of a heat-application drum 53 was set to 105° C.

As a result, the images deposited on a paper 51 were removed therefrom at an image peeling ratio of about 90%.

In the apparatus as illustrated in FIG. 5(*b*), an introducing roller 52 shown in FIG. 5(*a*) is not provided, and an image release endless belt 56 is disposed in such a configuration that a pressure-application drum 57, a separating roller 55, and transporting rollers 58 and 59 internally touch the image release endless belt 56. An image-deposited paper 51 impregnated with an image removal promoting liquid is inserted into a gap between the heat-application drum 53 and the image release endless belt 56, so that an image-deposited surface of the paper 51 is caused to closely adhere to the image release endless belt 56. Heat and pressure are applied to a laminated material of the image-deposited paper 51 and the image release endless belt 56 at the nip between the heat-application drum 53 and the pressure-application drum 57. Thus, images deposited on the paper 51 are attached or transferred to the surface of the image release endless belt 56. The width of the heat-application drum 53 in the axial direction thereof and the width of the image release endless belt 56 are made wider than that of the image-deposited paper 51, so that the water component of the image removal promoting liquid can be efficiently retained in the image-deposited surface portion of the paper 51 while the image-deposited paper 51 is transported with being held between the heat-application drum 53 and the image release endless belt 56.

After passing through the nip between the heat-application drum 53 and the pressure-application drum 57, the paper 51 is further heated in a sealed condition while transported along the circumference of the heat-application drum 53 to the separating roller 55. Thus, the adhesion of the image-constituting material to the paper 51 is decreased, thereby achieving the image removal from the paper 51 successively.

Comparative Example 4

The same recycling process for the image-deposited paper as in Example 6 was repeated except that the apparatus of FIG. 5(*b*) used in Example 6 was replaced by a conventional apparatus as shown in FIG. 6(*b*).

As a result, no images deposited on the paper 51 were removed therefrom when the surface temperature of the heat-application drum 53 was controlled to 105° C.

Then, the same recycling process as mentioned above was repeated with the surface temperature of the heat-application drum 53 being changed in a range of 70° to 150° C. When the surface temperature of the heat-application drum 53 was controlled to 120° C. or more, images were partially transferred to the surface of an image release drum 56A. In any case, however, the image peeling ratio was as low as 25% or less, and the surface portion of the paper, corresponding to the image area, was partially peeled off and transferred to the image release drum 56A.

In the conventional apparatus of FIG. 6(*b*), there is provided an image release drum 56A instead of the image release endless belt 56. The image-deposited paper 51 is caused to pass through the nip between the heat-application drum 53 and the image release drum 56A, with the image-deposited surface of the paper 51 being directed to the image release drum 56A to remove the image-constituting material from the paper 51. There is no means for retaining the water component of the water-containing image removal promoting liquid in the image-deposited surface portion of the paper 51.

The heat-application drum 53 comprises a surface layer made of a silicone rubber. The image release drum 56A is an aluminum drum coated by a polyester resin.

EXAMPLE 7

The same recycling process for the image-deposited paper as in Example 4 was repeated except that the apparatus of FIG. 5(*a*) used in Example 4 was replaced by an apparatus as shown in FIG. 5(*c*), and the coating amount of the image removal promoting liquid was changed to 2.6 mg/cm$^2$, that is, 1.6 g/A4 size.

The recycling apparatus as illustrated in FIG. 5(*c*) is characterized in that the image-deposited paper 51 is transported along the circumference of the heat-application drum 53, with the image-deposited paper 51 being held between an image release endless belt 56 and the heat-application drum 53 to retain the water component of the image removal promoting liquid in the image-deposited paper 51 before and after the image-deposited paper 51 is caused to pass through the nip between the heat-application drum 53 and a pressure-application drum 57. This configuration obtained by the apparatus of FIG. 5(*c*) is regarded as combination of the apparatus of FIG. 5(*a*) and that of FIG. 5(*b*).

As a result, all the images deposited on the paper were completely removed therefrom.

As previously explained, the heat-application drum 53 used in the apparatuses as shown in FIGS. 5(i a), 5(*b*) and 5(*c*) is an aluminum base drum coated by a fluorine-containing resin with a low surface energy, which can serve as a sealing member. Even if the image-constituting material transferred to the image release endless belt 56 cannot completely be cleaned thereof by the cleaning blades 5A and 5B, the image-constituting material remaining on the image release endless belt 56 does not transfer to the heat-application drum 53 is coated by a low-surface of the heat-application drum 53 is coated by a low-surface-energy material which shows poor adhesion to the image-constituting material. Therefore, the surface of the heat-application drum 53 is not stained with the image-constituting material throughout the recycling process. In addition, in the case where the paper which bears images on both sides thereof is inserted into such a recycling apparatus of FIG. 5(*a*), 5(*b*( or 5(*c*), the image-constituting material deposited on the surface which is not subjected to the image removal process can be prevented from transferring to the heat-application drum 53. Such advantages can also be obtained when the surface of the heat-application drum 53 may comprise a high-surface-energy material, such as a metal or hydrophilic polymeric material.

It is preferable that the sealing member comprise a portion in contact with the image-deposited surface portion of the recording material, comprising a low-surface-energy material with a surface energy of 20 mN/m or less or a high-surface-energy material with a surface energy of 40 mN/m or more.

In the apparatuses as shown in FIGS. 5(*a*), 5(*b*) and 5(*c*), the endless belt is employed as the image release member. Alternatively, the endless belt as used in FIGS. 5(*a*), 5(*b*) and 5(*c*) may be used as a sealing member, while the heat-application drum 53 may be used as an image release member if a material capable of showing the adhesion to the image-constituting material is used for the surface portion of the heat-application drum 53.

Furthermore, it is possible to remove the images deposited on both sides of the paper by one step when both the heat-application drum 53 and the image release endless belt can function as the image release members.

EXAMPLE 8

Toner images were formed on a commercially available high quality paper with a thickness of 75 μm, using a commercially available copying machine (Trademark "FT2200", made by Ricoh Company, Ltd.). The softening point of the toner was about 80° C. The same image removal promoting liquid as used in Example 4 was applied to the image-deposited surface of the paper with a coating amount of 3.7 mg/cm$^2$, that is, 2.3 g/A4 size.

Figure 7:
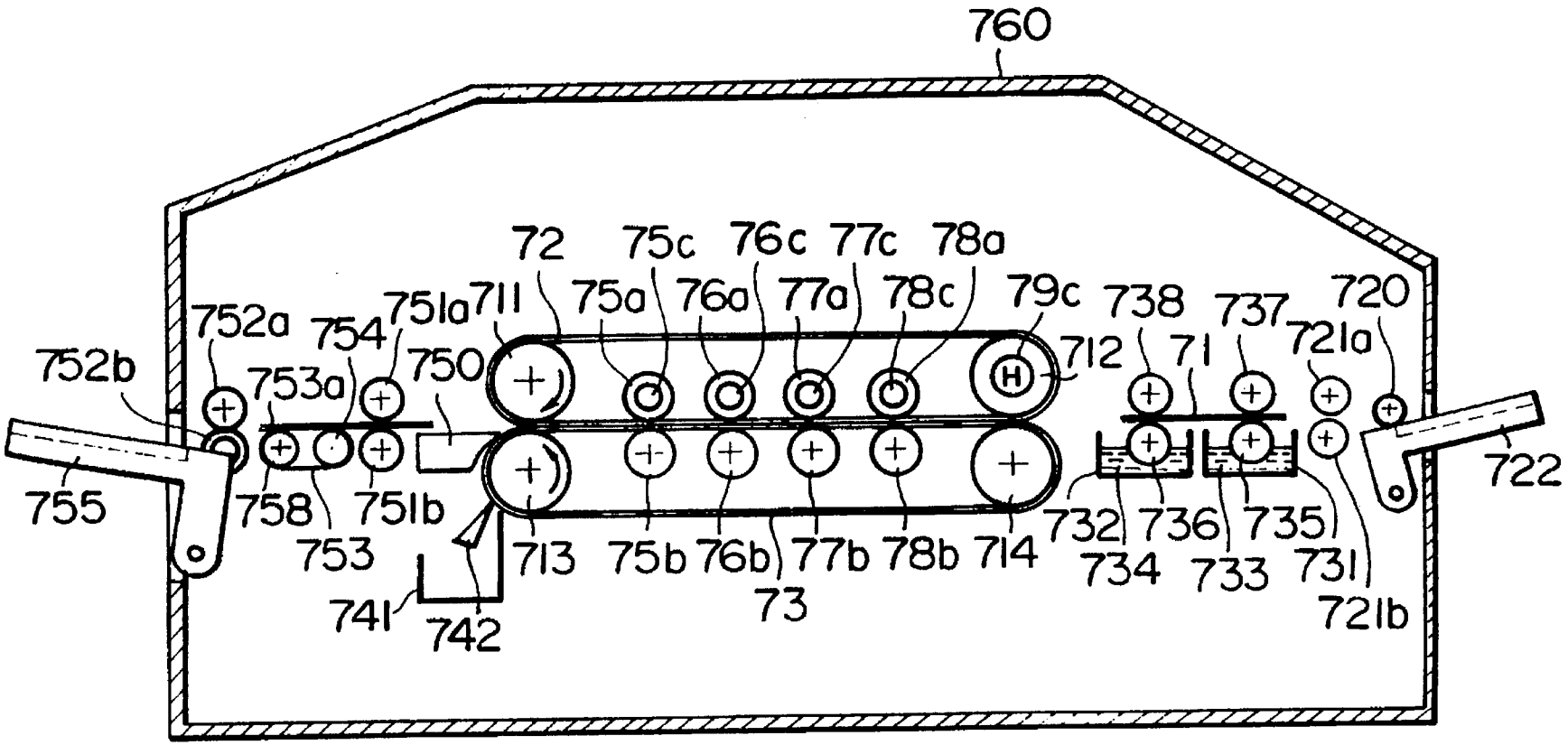
FIG. 7 is a schematic view which shows an example of the recycling apparatus according to the present invention, used in Example 8.

The recycling process of a toner-image-deposited paper was carried out using an apparatus as shown in FIG. 7.

As illustrated in FIG. 7, a toner-image-deposited paper 71 is transported from a paper stacker 722 to a recycling apparatus 760 by use of a transporting roller 720. An image removal promoting liquid 733 and an image removal promoting liquid 734, which are drawn from image removal promoting liquid containers 731 and 732 by use of coating rollers 735 and 736 respectively, are successively applied to the image-deposited surface of the paper 71. Reference numerals 721*a*, 721*b*, 737 and 738 indicate transporting rollers.

An image release member for use in the apparatus of FIG. 7 is an image release endless belt 73 with a thickness of about 50 μm, made of polyether ether ketone, which is a material through which the water component is not allowed to penetrate. A sealing member 72 is in the form of an endless belt comprising a nickel base belt with a thickness of about 35 82 m prepared by electroforming, and a surface layer with a thickness of about 20 μm, provided on the nickel base belt, comprising polytetrafluoro-ethylene, that is, a material through which the water component is not allowed to penetrate. The image release endless belt 73 is extended in such a configuration that pressure-application rollers 713, 75*b*, 76*b*, 77*b*, 78*b* and 714 internally touch the image release endless belt 73. Each of those pressure-application rollers 75*b*, 76*b*, 77*b*, 78*b* and 714 comprises an aluminum base drum and a silicone rubber surface layer with a thickness of about 2 mm provided on the aluminum base drum. The sealing endless belt 72 is extended in such a configuration that a pressure-application roller 711, and pressure- and heat-application rollers 75*a*, 76*a*, 77*a*, 78*a* and 712 internally touch the sealing endless belt 72. Each of those pressure- and heat-application rollers 75*a*, 76*a*, 77*a*, 78*a* and 712 comprises an aluminum base drum and a fluoroplastic surface layer with a thickness of about 5 μm provided on the aluminum base drum. A pair of endless belts 72 and 73 are driven in the same direction by a driving means (not shown).

The pressure- and heat-application rollers 75*a*, 76*a*, 77*a*, 78*a* and 712 have heaters 75*c*, 76*c*, 78*c* and 79*c*, respectively therein to heat the image-deposited paper 71. Each of those pressure- and heat-application rollers 75*a*, 76*a*, 77*a*, 78*a* and 712 is provided with a temperature sensor (not shown) to detect the surface temperature of each roller, and the data output by the temperature sensor is input into a temperature control system (not shown). The surface temperature of each roller is independently controlled by the temperature control system according to the output by the temperature sensor.

The pressure- and heat-application rollers 75*a*, 76*a*, 77*a*, 78*a*, and 712 are respectively urged to the opposite rollers 75*b*, 76*b*, 77*b*, 78*b* and 714 by a pressure- application means (not shown), so that pressure is applied to the image-deposited paper 71 and the image release endless belt 73 via the sealing endless belt 72.

Heat and pressure are applied to the image-deposited paper 71, with retaining the water component of the image removal promoting liquid in the image-deposited surface portion while the image-deposited paper 71 is transported with being held between the sealing endless belt 72 and the image release endless belt 73.

Then, the paper 71 is discharged from the gap between the rollers 711 and 713, and the paper is separated from image release endless belt 73 by the aid of a separator 750. Thereafter, the image-free paper 71 is surface-treated to have a surface smoothness as passing through the nip between pressure-application rollers 751*a* and 751*b*. Then, the paper 71 is dried as passing through a path between a drying belt 753 and a plate 753*a* through which the water component can be allowed to penetrate with the application of pressure to the paper 71. Reference numerals 754 and 756 indicate driving rollers for the drying belt 753. Finally, the paper 71 is sent to a paper tray 755 by means of rollers 752*a* and 752*b*.

The surface temperature of each of the rollers 75*a*, 76*a*, 77*a*, 78*a* and 712 was set to 90° C. in Example 8.

As a result, all the images deposited on the paper 71 were completely removed therefrom.

The recycling method as employed in Example 8 is characterized in that the image-constituting material is attached and transferred to the image release member by multiple application of pressure and heat to the image-deposited paper and the image release member, with retaining the water component of the image removal promoting liquid in the image-deposited surface portion of the paper.

EXAMPLE 9

The same recycling process for the image-deposited paper as in Example 8 was repeated using the apparatus as shown in FIG. 7 except that the coating amount of the image removal promoting liquid on the image-deposited surface of the paper was changed to 2.1 mg/cm$^2$, that is, 1.3 g/A4 size.

As a result, all the images deposited on the paper were completely removed therefrom.

EXAMPLE 10

Figure 8:
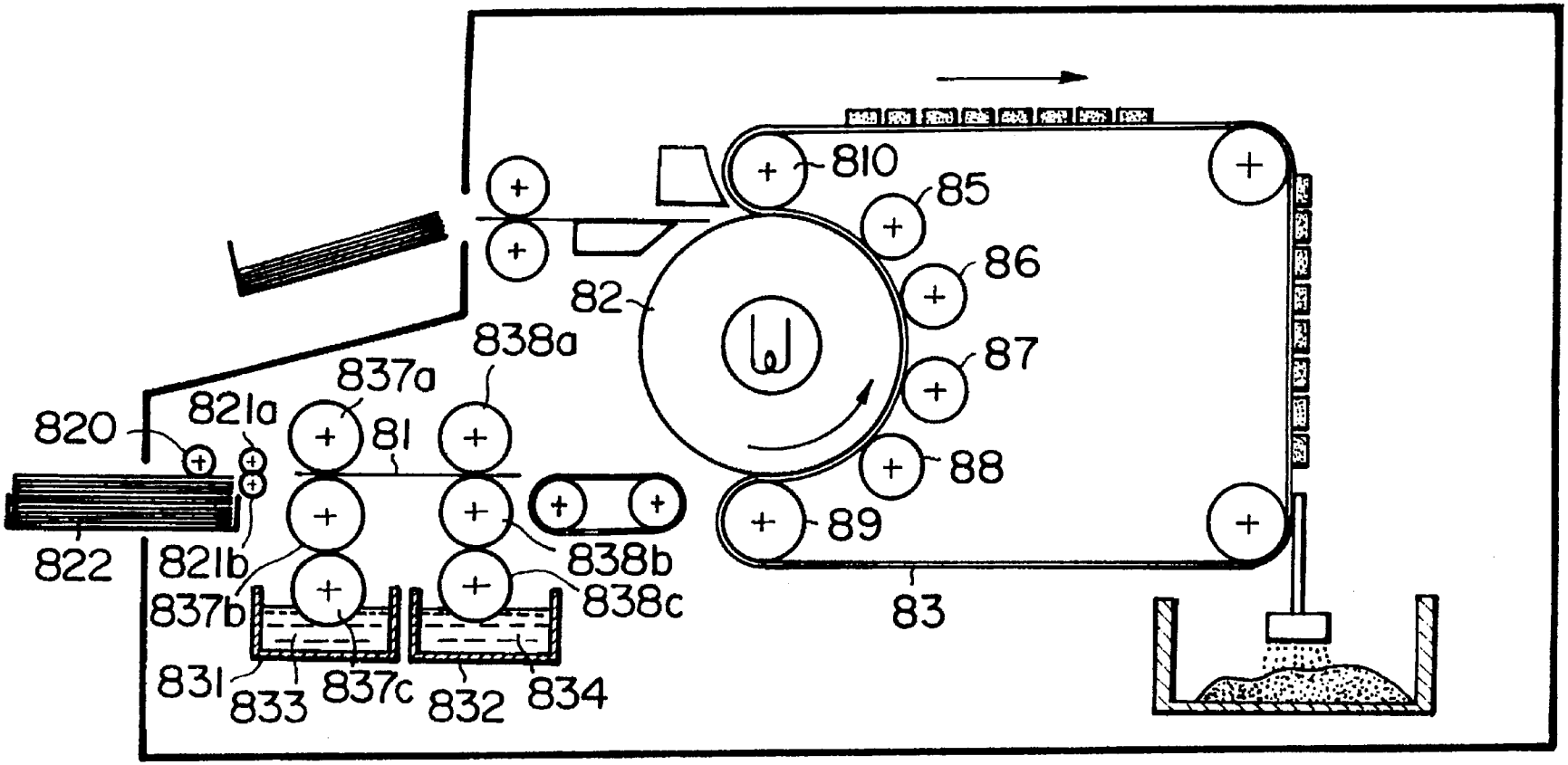
FIG. 8 is a schematic view which shows an example of the recycling apparatus according to the present invention, used in Example 10.

The same recycling process for the image-deposited paper as in Example 4 was repeated except that the apparatus on FIG. 5(*a*) used in Example 4 was replaced by an apparatus as shown in FIG. 8, and the surface temperature of a heat-application drum 82 was controlled to 90° C.

The recycling apparatus as illustrated in FIG. 8is characterized in that there are disposed a plurality of pressure-application rollers along the circumference of the heat-application drum 82.

As illustrated in FIG. 8, a toner-image-deposited paper 81 is transported from a paper stacker 822 to a recycling apparatus by use of a transporting roller 820. Reference numerals 821*a* and 821*b* indicate transporting rollers. An image removal promoting liquid 833 and an image removal promoting liquid 834, which are drawn from image removal promoting liquid containers 831 and 832 by means of coating rollers 837*c* and 838*c* respectively, are successively applied to the image-deposited surface of the paper 81 by use of rollers 837*a*, 837*b*, 838*a* and 838*b*.

An image release member in the apparatus of FIG. 8 is an image release endless belt 83 with a thickness of about 125 μm, made of polyimide, through which the water component is not allowed to penetrate. The image release endless belt 83 is extended along the circumference of the heat-application drum 82, with rollers 89 and 810, and pressure-application rollers 85, 86, 87 and 88 being internally touching the image release endless belt 83.

The pressure-application rollers 85, 86, 87 and 88 are urged to the heat-application drum 82 by a pressure-application means (not shown), so that the image release endless belt 83 is brought into pressure contact with the image-deposited surface of the paper 81.

As a result, all the images deposited on the paper 81 were completely removed therefrom at an image peeling ration of 100%.

EXAMPLE 11

The recycling process for the image-deposited paper as in Example 10 was repeated using the apparatus as shown in FIG. 8 except that the coating amount of the image removal promoting liquid on the image-deposited surface of the paper was changed from 3.7 mg/cm$^2$ to 2.1 mg/cm$^2$, that is, 1.3 g/A4 size.

As a result, all the images deposited on the paper were completely removed therefrom.

EXAMPLE 12

Toner images were separately formed on four kinds of commercially available high quality papers A, B, C and D, using a commercially available copying machine (Trademark, "FT6500", made by Ricoh Company, Ltd.). Each high quality paper was immersed into an image removal promoting liquid with the following formulation so as to have a coating amount of 7.4 mg/cm$^2$, that is, 4.6 g/A4 size.

| | wt. % |
|---|---|
| Silicone-based surfactant | 0.8 |
| Sodium alkylnaphthalenesulfonate | 0.7 |
| Water | 98.5 |

After the application of the image removal promoting liquid to each image-deposited paper, a 50-μm-thick polycarbonate film, serving as an image release member, was brought into contact with the image-deposited surface of the paper.

Two 100-μm-thick polyethylene terephthalate films were formed in a bag by attaching the one film to the other at both ends in the width direction of films and one end in the length direction thereof by use of a pressure-sensitive adhesive.

With the polycarbonate film serving as the image release member being in contact with the image-deposited surface of the paper which was impregnated with the image removal promoting liquid, such a laminated material of the polycarbonate film and the image-deposited paper was quickly sealed in the polyethylene terephthalate film bag serving as the sealing member, through which the water component of the water-containing image removal promoting liquid was not allowed to penetrate. The opening of the PET bag was sealed by a double-coated pressure-sensitive adhesive tape.

Using an apparatus as shown in FIG. 4, the laminated material of the image release member and the image-deposited paper, which was sealed in the polyethylene terephthalate film bag, was caused to pass through a nip between a heat- and pressure-application roller 45 with a surface temperature of 120° C. and a pressure-application roller 46.

Then, the image-deposited paper was taken out of the PET bag and separated from the image release member.

The result are as follows:

Paper A: All the images deposited on the paper A were completely removed therefrom.

Paper B: All the images deposited on the paper B were completely removed therefrom.

Paper C: The images were removed from the paper C at an image peeling ratio of about 70%, and the surface portion of the paper corresponding to an image area transferred to the image release member was partially peeled off and also transferred to the image release member.

Paper D: The images were removed from the paper D at an image peeling ratio of about 25%, and the surface portion of the paper corresponding to an image area transferred to the image release member was partially peeled off and also transferred to the image release member.

Furthermore, the laminated material of the image release member and the image-deposited paper was caused to repeatedly pass through the nip between the above-mentioned rollers 45 and 46 ten time.

Thereafter, the laminated material was taken out of the polyethylene terephthalate film bag, and the image release member was separated from the paper.

As a result, all the images deposited on each paper were completely removed therefrom.

As previously explained, in the case where the image-constituting material is attached transferred to the image release member by multiple application if heat and pressure thereto under such a condition that the water component of the image removal promoting liquid is retained in the image-deposited surface portion of the paper, the amount of image removal promoting liquid applied to the image-deposited surface can be reduced and the surface portion of the paper can be prevented from being peeled off. In addition, many kinds of papers and image-constituting materials can be subjected to such a recycling process. The reason for such advantages has not been clarified. It is supposed that the image release member and the image-deposited surface portion of the paper generate a slight slippage in the nip when pressure is applied to them by using a pressure-application roller. Consequently, while the image-constituting material is attached to the image release member, the image release member is microscopically separated from the paper. By such multiple application of pressure to the image-deposited paper and the image release member, the image-constituting material can be peeled from the paper completely.

When the heat- and pressure-application treatment is repeatedly carried out to positively cause the slippage between the image release member and the image-deposited paper, another advantage that the image release member can be smoothly separated from the image-free paper after the images are transferred to the image release member can be obtained. In such a case, even when images are deposited on the edge of a recording paper or there are many solid images on a recording paper, the image release member can be separated from the recording paper naturally. This advantage can be obtained because the adhesion between the recording paper and the image-constituting material is substantially lost after the image-constituting material deposited on the paper is repeatedly attached to the image release member and the image release member is repeatedly detached from the paper.

The image-constituting material for use in electrophotography or thermal transfer recording has generally hydrophobic nature. Once the hydrophobic image-constituting material is transferred to the image release member, the image-constituting material is scarcely returned to the recording material because the water component of the water-containing image removal promoting liquid exists on the surface portion of the recording material.

Therefore, to decrease the coating amount of the image removal promoting liquid and to improve the image peeling performance, it is preferable that heat and pressure be applied to the laminated material of the image-deposited paper and the image release member to cause the slippage therebetween under such a condition that the water component of the water-containing image removal promoting liquid is maintained in the surface portion of the image-deposited paper.

EXAMPLE 13

Figure 9:
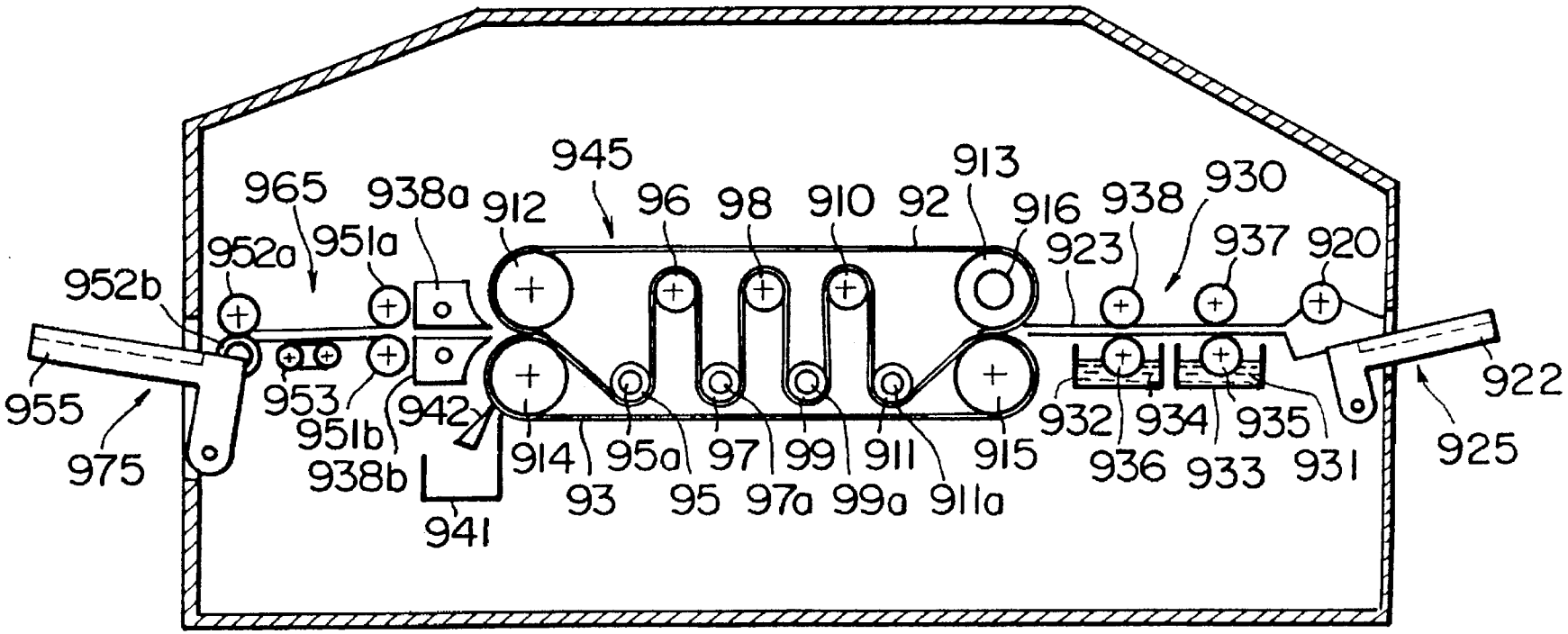
FIG. 9 is a schematic view which shows an example of the recycling apparatus according to the present invention, used in Example 13.

The recycling process was carried out using an apparatus as shown in FIG. 9.

In the apparatus as illustrated in FIG. 9 there are serially disposed a paper feeding means 925 for successively feeding the image-deposited recording material; an image removal promoting liquid application means 930 for applying an image removal promoting liquid to the image-deposited surface portion of the recording material; an image release means 945 for transferring images deposited on the recording material to an image release member under the application of heat and pressure thereto; a drying means 965 for drying the image-free recording material; and a paper discharging means 975 for discharging and accumulating the image-free papers.

The paper feeding means 925 comprises a paper-feeding tray 922 in which image-deposited recording materials are stored with the image-deposited surface of each recording material being directed to the bottom of the paper-feeding tray 922, and a paper-feeding roller 920.

The image removal promoting liquid application means 930 comprises image removal promoting liquid containers 931 and 932 respectively containing image removal promoting liquids 933 an 934, image removal promoting liquid drawing rollers 935 and 936 for respectively drawing the image removal promoting liquids 933 and 934, and a pair of guide plate 923 for leading the image-deposited recording materials from the paper feeding means 925 to the image release means 945. Reference numerals 937 and 938 indicate rollers for moving the recording material in a stable condition.

The image release means 945 comprises a pair of rollers 913 and 915 disposed upstream with respect to the transporting direction of the image-deposited recording material; a pair of rollers 912 and 914 disposed downstream with respect to the transporting direction thereof; a sealing endless belt 92 extended in tension around the rollers 913 and 912; an image release endless belt 93 extended in tension around the rollers 915 and 914; and pressure-application rollers 95, 96, 97, 98, 99, 910 and 911 which are disposed so that the contact portion of the sealing endless belt 92 and the image release endless belt 93 may form a zigzag transporting path for the image-deposited recording material.

For the sealing endless belt 92 and the image release endless belt 93, a commercially available polyethylene terephthalate film comprising as a filler titanium oxide, made by Toray Industries, Inc., that is a material through which the water component is not allowed to penetrate. These endless belts 92 and 93 are sufficiently longer and wider than the image-deposited recording material, both of which function as sealing member. Namely, the image release endless belt 93 also serves as the sealing member.

While the image-deposited recording material impregnated with an image removal promoting liquid is transported from a pair of rollers 913 and 915 toward a pair of rollers 912 and 914, the image-deposited recording material can be closely held between the sealing endless belt 92 and the image release endless belt 93, so that the water component of the water-containing image removal promoting liquid can be prevented from escaping from the image-deposited recording material.

A pair of separating claws 938*a* and 938*b* are disposed at the exit from rollers 912 and 914 to separate the recording material from the image release endless belt 93 and the sealing endless belt 92. A cleaning unit 941 equipped with a cleaning blade 942 is situated downstream of the separating claw 938*b* along the image release endless belt 93 for cleaning the image release endless belt 93.

The drying means 965, which is provided downstream of the separating claws 938*a* and 938*b*, comprises a pair of rollers 951*a* and 951*b*, a pair of rollers 952*a* and 952*b*, and a drying belt 953 over which the image-free recording material is transported.

The image-free recording material sent by a pair of rollers 952*a* and 952*b* is discharged to a paper discharge tray 955 in the paper discharging means 975.

In Example 13, the recycling process was carried out in the above-mentioned apparatus as shown in FIG. 9 in the following manner; an image-deposited recording material was sent from the paper-feeding tray 922 by means of paper-feeding roller 920, with the image-deposited surface being directed downward. Then, the image removal promoting liquids 933 and 934 respectively drawn by the drawing rollers 935 and 936 were successively applied to the image-deposited surface portion of the recording material in the image removal promoting liquid application means 930. The image-deposited recording material onto which the image removal promoting liquids 933 and 934 were applied was transported to the nip between the rollers 913 and 915 where a thermoplastic or thermofusible image-constituting material deposited on the recording material was brought into pressure contact with the image release endless belt 93. After passing through the nip between the rollers 913 and 915, the image-deposited recording material was transported as the movement of the image release endless belt 93, with the image-deposited surface of the recording material closely adhering to the surface of the image release endless belt 93. At the same time, the back side of the recording material, opposite to the image-deposited side, was also brought into close contact with the surface of the sealing endless belt 92. Namely, the image-deposited recording material transported, with being closely sandwiched between the image release endless belt 93 and the sealing endless belt 92. During the transportation of the image-deposited recording material in the image release means 945, the image-constituting material deposited on the recording material suffered a stress, to be described later in detail, because the image-deposited recording material followed a zigzag course with the application of predetermined heat and pressure thereto. Thus, the image-constituting material deposited on the recording material was transferred to the surface of the image release endless belt 93 and peeled from the recording material.

When the end of the recording material was slipped out of the gap between the rollers 912 an 914, the recording material was separated from the image release endless belt 93 and the sealing endless belt 92 by the aid of separating claws 938*a*938*b*. Then, the image-free recording material was transported toward the drying belt 953 by a pair of rollers 951*a* and 951*b*, and then subjected to drying treatment. Finally, the image-free recording material was discharged to the paper discharge tray 955.

The image-constituting material transferred to the image release endless belt 93 was removed therefrom by the cleaning blade 942, so that the image release endless belt 93 was ready for the next recycling process.

In the case where the amount of image removal promoting liquid applied to the image-deposited surface portion of the recording material can be reduced to the minimum, the thermal energy required for the drying belt 953 can be decreased because only a slight amount of water content remains on the recording material.

When the image removal promoting liquid is applied to the image-deposited surface portion of the recording material by one step, one of the drawing roller 935 or 936 may be taken away.

In the apparatus as shown in FIG. 9, the images are transferred to the image release endless belt 93 with the application of heat to the image-deposited recording material using heaters 916, 95*a*, 97*a*, 99*a* and 911*a* respectively included in the rollers 913, 95, 97, 99 and 911. In this case, all rollers located along the zigzag transporting path may not be provided with the heat-application means. For the application of heat to the image-deposited recording material, hot air may be totally sent to the zigzag path which is a substantially sealed system, or the heating medium such as hot air may be caused to blow into each roller.

Furthermore, both ends of the image release endless belt 93 and the sealing endless belt 92 in the transporting direction may adhere by use of a pressure-sensitive adhesive to effectively prevent the evaporation and escape of the water component of the water-containing image removal promoting liquid from the image-deposited recording material. In particular, such adhesion of the image release endless belt 93 and the sealing endless belt 92 by the adhesive is effective when image transfer and peeling must be carried out at a temperature higher than the boiling point of water because the softening of fusing point of the image-constituting material is remarkably high.

Toner images were formed on a commercially available PPC paper, using a commercially available copying machine (Trademark "IMAGIO 320 FP1", made by Ricoh Company, Ltd.). An aqueous solution containing a commercially available surfactant "BT-7" (Trademark, made by Nikko Chemicals Co., Ltd.) in an amount of 1 wt. %, serving as an image removal promoting liquid 933 was drawn from the container 931 by use of the drawing roller 935, and applied to the image-deposited surface of copy paper in a coating among of about 0.48 mg/cm$^2$, that is, 0.3 g/A4 size.

The copy paper impregnated with the image removal promoting liquid 933 was transported, and caused to closely adhere to the image release endless belt 93 and the sealing endless belt 92 when passing through the nip between the rollers 913 and 915. The image-deposited copy paper was transported along the zigzag path which was designed by disposing the pressure-application rollers 910, 98 and 96, and the pressure- and heat-application rollers 911, 99, 97 and 95, each of which was heated to 90° to 150° C., in a zigzag configuration.

Thus, all the toner images deposited on the copy paper were completely transferred to the image release endless belt 93, and the copy paper was separated from the image release endless belt 93 by the separating claws 938*a* and 938*b*. The copy paper was dried over the drying belt 953, so that an image-free PPC paper was obtained.

The thus recycled PPC paper was again subjected to the image formation process. As a result, clear images were formed on the PPC paper. Such an operation of image formation and image peeling was repeated 5 times. The result was that clear toner images were formed on the copy paper exactly in the same state as first formed.

COMPARATIVE EXAMPLE 5

Tower images were formed on a commercially available copy paper and peeled therefrom in the same manner as in Example 13 except that the recycling apparatus of FIG. 9 used in Example 13 was replaced by a conventional apparatus as shown in FIG. 1.

As a result, the images deposited on the paper were not sufficiently removed therefrom.

When the coating amount of the image removal promoting liquid was increased to about 4.8 mg/cm$^2$, that is 3.0 g/A4 size, the image removal was carried out satisfactorily.

EXAMPLE 14

Toner images were formed on a commercially available copy paper and peeled therefrom in the same manner as in Example 13 except that the image removal promoting liquid for use in Example 13 was replaced by an aqueous solution containing a commercially available surfactant "BT-12" (Trademark, made by Nikko Chemicals Co., Ltd.) in an amount of 0.3 wt. %, and the coating amount of the image removal promoting liquid onto the copy paper was changed from about 0.48 mg/cm$^2$ to about 0.80 mg/cm$^2$, that is, 0.5 g/A4 size.

As a result, a PPC paper free from images was obtained.

The above operation of image formation and image peeling was repeated 5 times. Clear toner images were formed on the copy paper exactly in the same state as first formed throughout the above five operations.

COMPARATIVE EXAMPLE 6

Toner images were formed on a commercially available copy paper and peeled therefrom in the same manner as in Example 14 except that the recycling apparatus of FIG. 9 used in Example 14 was replaced by a conventional apparatus as shown in FIG. 1.

As a result, the images deposited on the paper were not sufficiently removed therefrom.

When the coating amount of the image removal promoting liquid was increased to about 5.5 mg/cm$^2$, that is 3.4 g/A4 size, the image removal was carried out satisfactorily.

EXAMPLE 15

Toner images were formed on a commercially available copy paper and peeled therefrom in the same manner as in Example 13 except that the image removal promoting liquid for use in Example 13 was replaced by an aqueous solution containing a commercially available surfactant "MA-80" (Trademark, made by Mitsui-Cyanamid, Ltd.) in an amount of 2 wt. %, and the coating amount of the image removal promoting liquid onto the copy paper was changed from about 0.48 mg/cm$^2$ to about 0.16 mg/cm$^2$, that is, 0.1 g/A4 size.

As a result, a PPC paper free from images was obtained.

The above operation of image formation and image peeling was repeated 5 times. Clear toner images were formed on the copy paper exactly in the same state as first formed throughout the above five operations.

COMPARATIVE EXAMPLE 7

Toner images were formed on a commercially available copy paper and peeled therefrom in the same manner as in Example 15 except that the recycling apparatus of FIG. 9 used in Example 15 was replaced by a conventional apparatus as shown in FIG. 1.

As a result, the images deposited on the paper were not sufficiently removed therefrom.

When the coating amount of the image removal promoting liquid was increased to about 4.5 mg/cm$^2$, that is 2.9 g/A4 size, the image removal was carried out satisfactorily.

EXAMPLE 16

Toner images were formed on a commercially available copy paper and peeled therefrom in the same manner as in Example 13 except that the image removal promoting liquid for use in Example 13 was replaced by an aqueous solution containing a commercially available surfactant "S-113" (Trademark, made by Asahi Glass Co., Ltd.) in an amount of 5 wt. %.

As a result, a PPC paper free from images was obtained.

The above operation of image formation and image peeling was repeated 5 times. Clear toner images were formed on the copy paper exactly in the same state as first formed throughout the above five operations.

EXAMPLE 17

Toner images were formed on a commercially available copy paper and peeled therefrom in the same manner as in Example 13 except that the application of the image removal promoting liquid was carried out by two steps in such a fashion that an aqueous solution containing a commercially available surfactant "BT-7" (Trademark, made by Nikko Chemicals Co., Ltd.) in an amount of 30 wt. %, serving as an image removal promoting liquid 933, was drawn from a container 931 by a drawing roller 935 and first applied to the image-deposited surface of the copy paper with a coating amount of about 80 μg/cm$^2$, that is, 0.05 g/A4 size, and then water serving as an image removal promoting liquid 934 was drawn from a container 932 by a drawing roller 936 and again applied to the image-deposited surface of the copy paper with a coating amount of about 80 μg/cm$^2$, that is, 0.05 g/A4 size.

As a result, a PPC paper free from images was obtained.

The above operation of image formation and image peeling was repeated 5 times. Clear toner images were formed on the copy paper exactly in the same state as first formed throughout the above five operations.

EXAMPLE 18

Toner images were formed on a commercially available copy paper and peeled therefrom in the same manner as in Example 13 except that the application of the image removal promoting liquid was carried out by two steps in such a fashion that an aqueous solution containing a commercially available surfactant "BT-12" (Trademark, made by Nikko Chemicals Co., Ltd.) in an amount of 10 wt. %, serving as an image removal promoting liquid 933, was drawn from a container 931 by a drawing roller 935 and first applied to the image-deposited surface of the copy paper with a coating amount of about 160 μg/cm$^2$, that is, 0.1 g/A4 size, and then water serving as an image removal promoting liquid 934 was drawn from a container 932 by a drawing roller 936 and again applied to the image-deposited surface of the copy paper with a coating amount of about 0.48 mg/cm$^3$, that is, 0.3 g/A4 size.

As a result, a PPC paper free from images was obtained.

The above operation of image formation and image peeling was repeated 5 times. Clear toner images were formed on the copy paper exactly in the same state as first formed throughout the above five operations.

EXAMPLE 19

Toner images were formed on a commercially available copy paper and peeled therefrom in the same manner as in Example 13 except that the application of the image removal promoting liquid was carried out by two steps in such a fashion that an aqueous solution containing a commercially available surfactant "MA-80" (Trademark, made by Mitsui-Cyanamid, Ltd.) in an amount of 15 wt. %, serving as an image removal promoting liquid 933, was drawn from a container 931 by a drawing roller 935 and first applied to the image-deposited surface of the copy paper with a coating amount of about 0.11 mg/cm$^2$, that is, 0.07 g/A4 size, and then water serving as an image removal promoting liquid 934 was drawn from a container 932 by a drawing roller 936 and again applied to the image-deposited surface of the copy paper with a coating amount of about 0.16 mg/cm$^2$, that is, 0.1 g/A4 size.

As a result, a PPC paper free from images was obtained.

The above operation of image formation and image peeling was repeated 5 times. Clear toner images were formed on the copy paper exactly in the same state as first formed throughout the above five operations.

EXAMPLE 20

Toner images were formed on a commercially available copy paper and peeled therefrom in the same manner as in Example 13 except that the application of the image removal promoting liquid was carried out by two steps in such a fashion that an aqueous solution containing a commercially available surfactant "S-113" (Trademark, made by Asahi Glass Co., Ltd.) in an amount of 20 wt. %, serving as an image removal promoting liquid 933, was drawn from a container 931 by a drawing roller 935 and first applied to the image-deposited surface of the copy paper with a coating amount of about 0.096 mg/cm$^2$, that is, 0.06 g/A4 size, and then water serving as an image removal promoting liquid 934 was drawn from a container 932 by a drawing roller 936 and again applied to the image-deposited surface of the copy paper with a coating amount of about 0.32 mg/cm$^2$, that is, 0.2 g/A4 size.

As a result, a PPC paper free from images was obtained.

The above operation of image formation and image peeling was repeated 5 times. Clear toner images were formed on the copy paper exactly in the same state as first formed throughout the above five operations.

As previously mentioned in Examples 13 through 20, when the image-deposited surface of the recording material which is in close contact with the image release member is transported along the zigzag path, with the image-constituting material deposited on the recording material being in a softened of fused condition, and the image removal promoting liquid being maintained in the image-deposited surface portion of the recording material, as illustrated in FIG. 9, the image-constituting material can easily be peeled from the recording material by the application of a small amount of image removal promoting liquid.

The reason for the above-mentioned advantage will be explained in detail with reference to FIGS. 10(*a*) to 10(*c*).

Figures 10A, 10B, 10C:
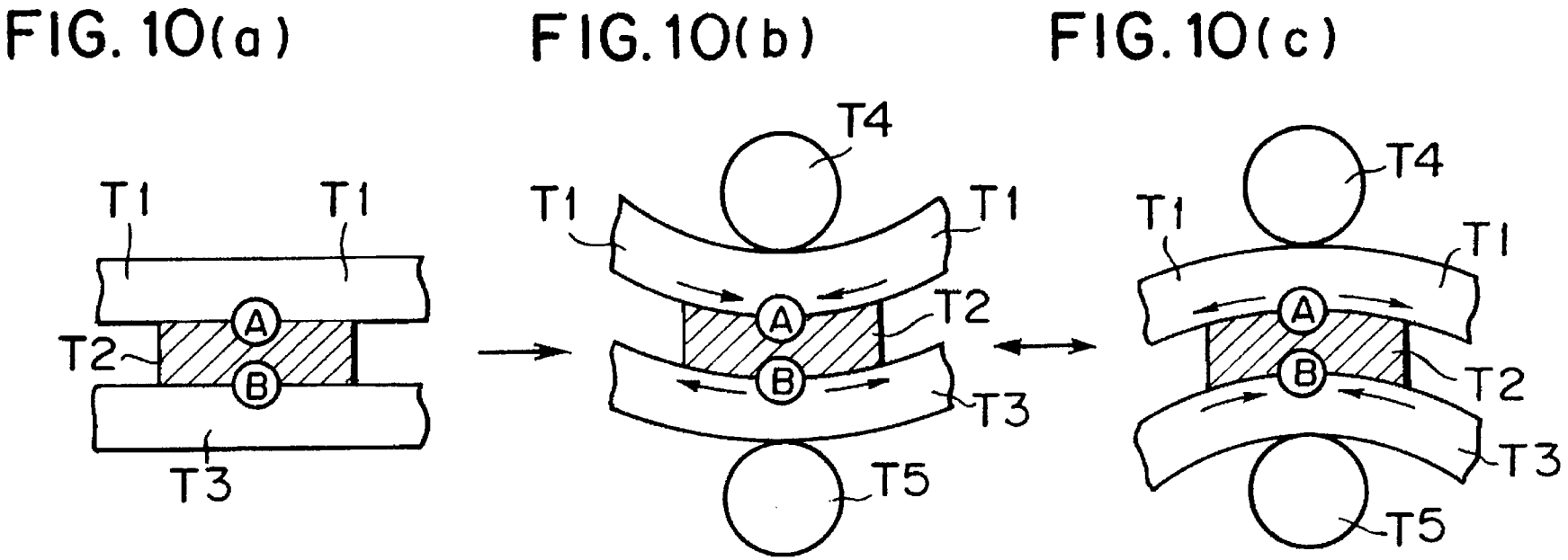
FIG. 10(*a*) through 10(*c*) are schematic cross-sectional views in explanation of the mechanism of image peeling operation obtained by use of the apparatus as shown in FIG. 9.

As shown in FIG. 10(*a*), an image-constituting material T2 deposited on a recording material T1 is in close contact with an image release member T3. Suppose that the image-deposited recording material T1 is transported along the zigzag path with closely adhering to the image release member T3 as shown in FIG. 9. In this case, the image release member T3 is caused to extend and the recording material T1 is caused to shrink relatively when they are curved around a pressure-application roller T4 as shown in FIG. 10(*b*). In contrast to this, the image release member T3 is caused to shrink and the recording material T1 is caused to extend relatively when they are curved around a pressure-application roller T5 as shown in FIG. 10(*c*). Due to such a zigzag movement, the stress is generated in the direction of arrows, for example, at a position A of the recording material T1 and at a position B of the image release member T3. The stress causes a slight slippage between the image-deposited surface portion of the recording material T1 and the image release member T3, thereby gradually separating the image-constituting material T2 from the recording material T1 microscopically.

To remove the image-constituting material from the recording material only by the transporting system of the zigzag path as shown in FIG. 9, a tension applied to the image release endless belt of FIG. 9 may be increased as compared with the tension applied to the image release endless belt as shown in FIGS. 7 and 8. Thus, the image-constituting material in a softened or fused condition can be attached to the surface of the image release endless belt by the application of high tension of the image release endless belt. The image-constituting material attached to the image release endless belt is scarcely returned to the recording material because the water component of the image removal promoting liquid remains on the surface portion of the recording material. Thus, the image-constituting material is attached to the image release member and separated from the recording material repeatedly while the image-deposited recording material is transported along the zigzag path, thereby effectively achieving the image removal from the recording material.

Instead of employing the zigzag path as shown in FIG. 9, the image-deposited recording material and/or the image release member may be intermittently moved, or be moved with repeated speed variation, or be repeatedly moved backward and forward, in order to cause the slippage between the image-deposited surface portion of the recording material and the image release member with maintaining the water component of the image removal promoting liquid in the image-deposited surface portion of the recording material. In such a case, the slippage can be generated because of differences between the frictional resistance of the recording material and that of the image release member with respect to other members, or difference in inertia force, or difference in the backlash of the respective driving systems for the recording material and the image release member. Alternatively, both of the image-deposited recording material and the image release member may be moved in the same direction at different speeds, or they may be transported in the opposite directions.

In particular, to move the image-deposited recording material and the image release member with repeated speed variation can be achieved by a relatively simple apparatus. For example, an eccentric roller, a grooved roller, a roller provided with convex and concave portions thereon at random may be employed for the rollers 85, 86, 87 and 88 of the recycling apparatus as shown in FIG. 8 to press the image-deposited recording material and the image release member. In addition, the image-constituting material deposited on the recording material can be efficiently removed therefrom by allowing the pressure-application rollers having convex and concave portions thereon to press the image-deposited recording material even though the number of pressure-application rollers is decreased.

Furthermore, in the apparatus of FIG. 7, the slippage between the image-deposited recording material 71 and the image release endless belt 73 can be positively caused, for example, by rotating the pressure-application rollers 75*a* and 77*b* in the direction opposite to the transporting direction. The slippage can be caused by driving every other roller or at least one of the opposite rollers to rotate in the direction opposite to the transporting direction. Thus, the image-constituting material can be effectively removed from the recording material even though the number of pairs of rollers is reduced.

In particular, when there is employed a recording material, at least a surface portion of which comprises a paper layer comprising cellulose fibers, the above-mentioned image removal method of utilizing the slippage between the image-deposited recording material and the image release member is advantageous because the image-constituting material can be removed from the recording material without peeling the cellulose fibers from the paper layer of the recording material or roughening the surface portion of the recording material. The reason for this is that the slippage stress works in the horizontal direction of the surface of the recording material, so that the cellulose fibers can be prevented from rising. In addition, the image-constituting material is separated from the recording material in a microscopic area, so that it is supposed that the bond strength of the cellulose fibers in the paper layer is not so easily weakened.

Conventionally, it is difficult to perfectly remove the image-constituting material from the cellulose fibers of the paper layer by one-time transfer operation because the image-constituting material penetrates to the inside of the paper layer, and the cellulose fibers are not readily moved by such a microscopic separation of the image-constituting material from the paper layer of the recording material. However, when the apparatuses of FIGS. 7 to 9 are employed, the image-constituting material can be gradually transferred to the image release member by multiple transferring steps, with the water component of the water-containing image removal promoting liquid remaining in the paper layer of the recording material. Finally, the images can be removed from the recording material more completely as compared with the case where the conventional recycling apparatus is employed.

In Examples 21 through 33 the image-constituting material was removed from the recording material in such a manner that the image-deposited recording material and the image release member were transported in the opposite directions to cause the slippage between the image-deposited surface portion of the recording material and the image release member.

EXAMPLE 21

Figure 11:
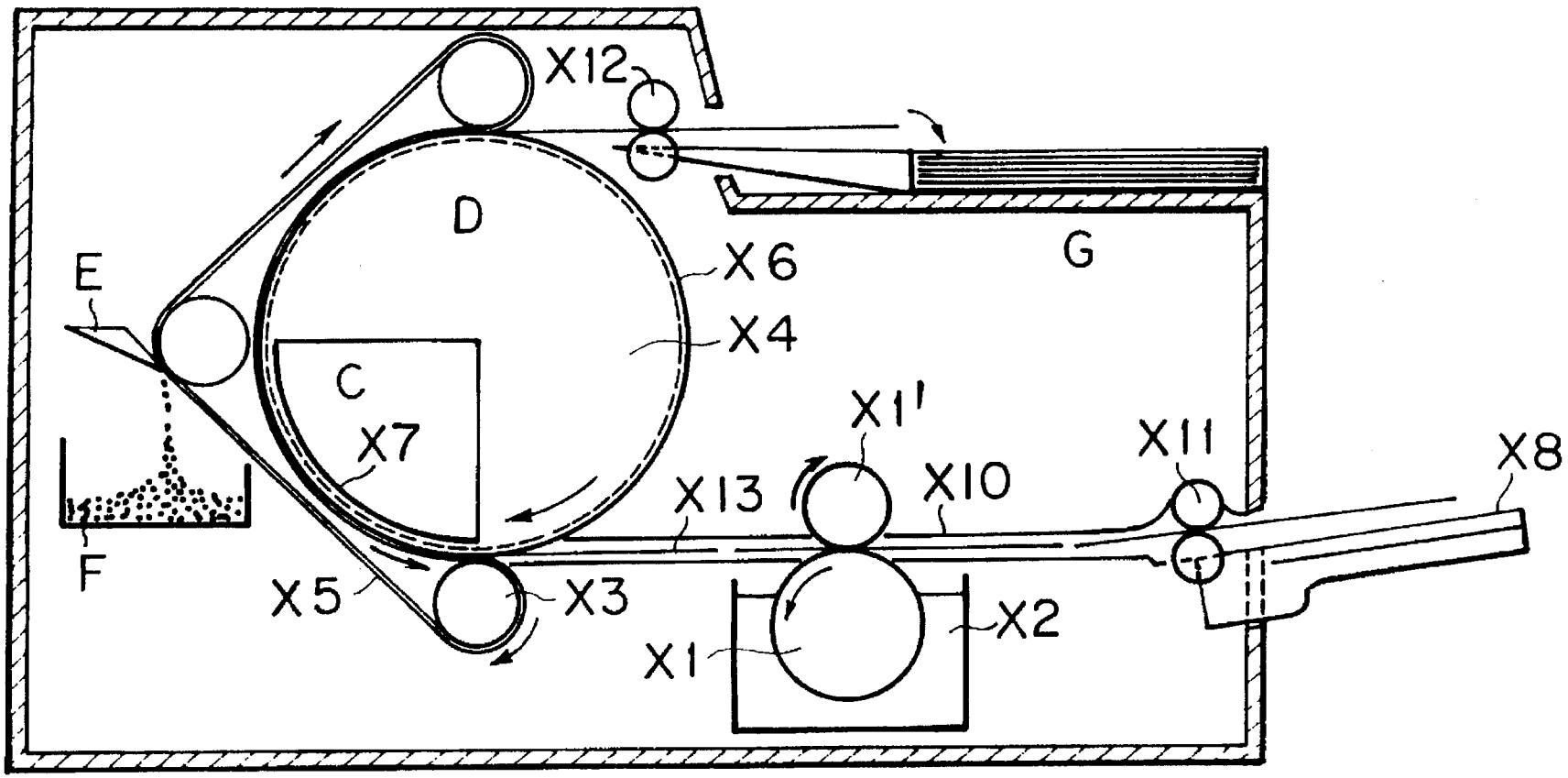
FIG. 11 is a schematic view which shows an example of the recycling apparatus according to the present invention, used in Example 21.

In Example 21 an image-deposited recording material and an image release member were transported in the opposite directions to cause the slippage therebetween, using an apparatus as shown in FIG. 11.

In the apparatus as illustrated in FIG. 11, an image release endless belt X5 is made of nickel through which the water component is not allowed to penetrate. The image release endless belt X5 is disposed in such a configuration that the image release endless belt X5 is caused to move on a drum X4 along approximately half the circumference of the drum X4. The drum X4 serves to transport, heat and dry an image-deposited recording material X13. The image release endless belt X5 is driven in rotation in an opposite direction to the rotational direction of the drum X4 at a speed of about 1/10 the linear speed of the drum X4 to cause the slippage between the image release endless belt X5 and the image-deposited recording material X13.

The image-deposited recording material X13, which is placed in a paper feed tray X8 with the image-deposited surface being directed to the bottom of the paper feed tray X8, is transported from the paper feed tray X8 by a paper feed roller X11. Then, a water-containing image removal promoting liquid X2 is applied to the image-deposited surface portion of the recording material X13 by means of a coating roller X1 and a coating assistant roller X1'.

Figure 12:
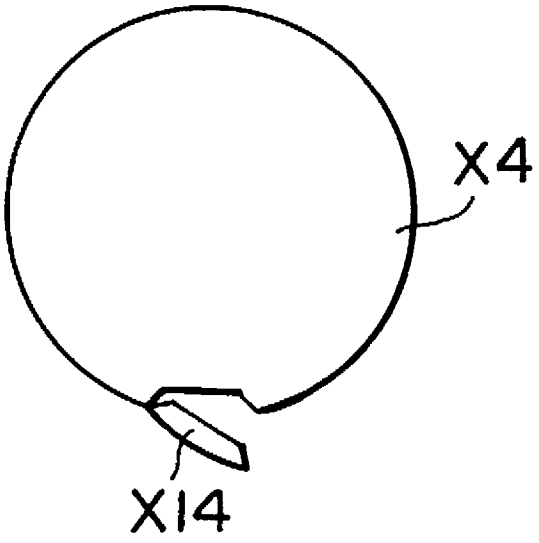
FIG. 12 is a partially sectional view of a drum X4 shown in the apparatus of FIG. 11.

The drum X4 is provided with a clamp X14 for holding the end of the image-deposited recording material X13 as shown in FIG. 12. When the image-deposited recording material X13 is introduced into a gap between the drum X4 and a transporting roller X3, the end portion of the recording material X13 is held by the clamp X14 of the drum X4. In the case where the image-constituting material deposited on the recording material is removed therefrom by causing a considerable slippage between the image-deposited recording material and the image release member, it is preferable to provide the above-mentioned means for holding the end of the recording material to transport it in a stable condition. Thus, images can be efficiently removed from the recording material and the recording material can be prevented from becoming creased during the repeated transfer operations.

The image-deposited recording material X13 is brought into pressure contact with the image release endless belt X5 when entering the gap between the drum X4 and the transporting roller X3. The image-deposited recording material X13 is subjected to heat- and pressure-application treatment in an image release area C while the recording material X13 is transported along the drum X4. Thus, the image-constituting material is easily removed from the recording material by utilizing the slippage between the recording material X13 and the image release endless belt X5. The thus obtained image-free recording material is dried while transported along the drum X4 in an drying area D, and then discharged to a paper discharge tray G.

The image-constituting material attached and transferred to the surface of the image release endless belt X5 is scraped off by use of a cleaning claw E and collected in a container F. Thus, the image release endless belt X5 is cleaned to get ready for the next recycling process.

The surface of the drum X4 is provided with numerous holes X6. In the image release area C the holes are sealed with a sealing member X7 that is a stainless plate through which the water component of the image removal promoting liquid is not allowed to penetrate. Therefore, the image-constituting material can efficiently be attached or transferred from the recording material X13 to the image release endless belt X5, with retaining the water component of the water-containing image removal promoting liquid X2 in the image-deposited surface portion of the recording material. On the contrary, the sealing member X7 is not provided in the drying area D, so that the water vapor generated from the recording material by the application of heat thereto can be scattered through the holes X6 of the drum X4. Thus, the image-free recording material is satisfactorily dried and smoothened.

As previously explained, the heat source is common to the image release area C and the drying area D in the apparatus of FIG. 11, so that the apparatus can be simplified and the cost can be reduced.

In such an embodiment, a material with permeability to water component may be used for the drum X4 as long as the sealing member X7 is provided in the image release area C. Alternatively, a porous material or a material with permeability to water component may be used for the image release endless belt X5. In such a case, the back side of the image release endless belt X5, opposite to the side in contact with the image-deposited surface of the recording material X13, may be selected with a sealing member in a range corresponding to the image release area C.

In FIG. 11, reference numeral X10 indicates a guide plate; and reference numeral X12, a discharging roller.

In Example 21, toner images were formed on a commercially available PPC paper, using a commercially available copying machine (Trademark "IMAGIO 320 FP1", made by Ricoh Company, Ltd.). The toner images were removed from the copy paper using an apparatus as illustrated in FIG. 11. An aqueous solution containing a commercially available surfactant "BT-7" (Trademark, made by Nikko Chemicals Co., Ltd.) in an amount of 1 wt. %, serving as the image removal promoting liquid X2 was drawn from a container by use of the coating roller X1, and applied to the image-deposited surface of copy paper in a coating amount of about 0.8 mg/cm$^2$, that is, 0.5 g/A4 size.

While the copy paper impregnated with the image removal promoting liquid X2 was transported around the drum X4, with causing the image-deposited surface of the copy paper to closely adhere to the image release endless belt X5, the toner images were satisfactorily removed from the copy paper and the image-free copy paper was dried, and an image-free copy paper with good surface smoothness was obtained again.

The thus recycled PPC paper was again subjected to the image formation process using the same copying machine as previously employed. As a result, clear images were formed on the PPC paper. Such an operation of image formation and image peeling was repeated 10 times. The result was that clear toner images were formed on the copy paper exactly in the same state as first formed.

COMPARATIVE EXAMPLE 8

Toner images were formed on a commercially available copy paper and peeled therefrom in the same manner as in Example 21 except that the recycling apparatus of FIG. 11 used in Example 21 was replaced by a conventional apparatus as shown in FIG. 1.

As a result, the images deposited on the paper were not sufficiently removed therefrom.

EXAMPLE 22

Toner images were formed on a commercially available copy paper and peeled therefrom in the same manner as in Example 21 except that the image removal promoting liquid for use in Example 21 was replaced by an aqueous solution containing a commercially available surfactant "TONER-CLEAN 205" (Trademark, made by Nippon Nyukazai Co., Ltd.) in an amount of 1 wt. %, and the coating amount of the image removal promoting liquid onto the copy paper was changed from about 0.8 mg/cm$^2$ to about 0.61 mg/cm$^3$, that is, 0.38 g/A4 size.

As a result, a copy paper free from images with excellent surface smoothness was obtained.

The thus recycled PPC paper was again subjected to the image formation process using the same copying machine as previously employed. As a result, clear images were formed on the PPC paper. Such an operation of image formation and image peeling was repeated 10 times. The result was that clear toner images were formed on the copy paper exactly in the same state as first formed.

Example 23

Toner images were formed on a commercially available copy paper and peeled therefrom in the same manner as in Example 21 except that the image removal promoting liquid for use in Example 21 was replaced by an aqueous solution containing as a water-soluble polymer a starch in an amount of 2 wt. %.

As a result, a copy paper free from images with excellent surface smoothness was obtained.

The thus recycled PPC paper was again subjected to the image formation process using the same copying machine as previously employed. As a result, clear toner images were formed on the copy paper exactly in the same state as first formed.

The above operation of image formation and image peeling was repeated 10 times. Clear toner images were formed on the copy paper exactly in the same state as first formed even after the above operation was repeated 10 times.

EXAMPLE 24

Toner images were formed on a commercially available copy paper and peeled therefrom in the same manner as in Example 21 except that the image removal promoting liquid for use in Example 21 was replaced by an aqueous solution containing as a water-soluble polymer carboxymethylcellulose in an amount of 2 wt. %, and the coating amount of the image removal promoting liquid onto the copy paper was changed from about 0.8 mg/cm$^2$ to about 1.3 mg/cm$^2$, that is, 0.8 g/A4 size.

As a result, a copy paper free from images with excellent surface smoothness was obtained.

The thus recycled PPC paper was again subjected to the image formation process using the same copying machine as previously employed. As a result, clear toner images were formed on the copy paper exactly in the same state as first formed.

The above operation of image formation and image peeling was repeated 10 times. Clear toner images were formed on the copy paper exactly in the same state as first formed even after the above operation was repeated 10 times.

EXAMPLE 25

Toner images were formed on a commercially available copy paper and peeled therefrom in the same manner as in Example 21 except that the image removal promoting liquid for use in Example 21 was replaced by an aqueous solution containing a commercially available surfactant "TONER-CLEAN 205" (Trademark, made by Nippon Nyukazai Co., Ltd.) in an amount of 1.5 wt. % and a starch as a water-soluble polymer in an amount of 3 wt. %, and the coating amount of the image removal promoting liquid onto the copy paper was changed from about 0.8 mg/cm$^2$ to about 0.32 mg/cm$^3$, that is, 0.2 g/A4 size.

As a result, a copy paper free from images with excellent surface smoothness was obtained.

The thus recycled PPC paper was again subjected to the image formation process using the same copying machine as previously employed. As a result, clear toner images were formed on the copy paper exactly in the same state as first formed.

The above operation of image formation and image peeling was repeated 10 times. Clear toner images were formed on the copy paper exactly in the same state as first formed even after the above operation was repeated 10 times.

EXAMPLE 26

Toner images were formed on a commercially available copy paper and peeled therefrom in the same manner as in Example 21 except that the image removal promoting liquid for use in Example 21 was replaced by an aqueous solution containing a commercially available surfactant "TONER-CLEAN 205" (Trademark, made by Nippon Nyukazai Co., Ltd.) in an amount of 1.5 wt. % and carboxymethyl cellulose as a water-soluble polymer in an amount of 2 wt. %, and the coating amount of the image removal promoting liquid onto the copy paper was changed from about 0.8 mg/cm$^2$ to about 1.6 mg/cm$^2$, that is, 1 g/A4 size.

As a result, a copy paper free from images with excellent surface smoothness was obtained.

The thus recycled PPC paper was again subjected to the image formation process using the same copying machine as previously employed. As a result, clear toner images were formed on the copy paper exactly in the same state as first formed.

The above operation of image formation and image peeling was repeated 10 times. Clear toner images were formed on the copy paper exactly in the same state as first formed even after the above operation was repeated 10 times.

EXAMPLE 27

Toner images were formed on a commercially available copy paper and peeled therefrom in the same manner as in Example 21 except that the image removal promoting liquid for use in Example 21 was replaced by an aqueous solution containing a commercially available surfactant "BT-7" (Trademark, made by Nikko Chemicals Co., Ltd.) in an amount of 0.02 wt. %, and the coating amount of the image removal promoting liquid onto the copy paper was changed from about 0.8 mg/cm$^2$ to about 0.64 mg/cm$^3$, that is, 0.4 g/A4 size.

As a result, a copy paper free from images with excellent surface smoothness was obtained.

The thus recycled PPC paper was again subjected to the image formation process using the same copying machine as previously employed. As a result, clear toner images were formed on the copy paper exactly in the same state as first formed.

The above operation of image formation and image peeling was repeated 10 times. Clear toner images were formed on the copy paper exactly in the same state as first formed even after the above operation was repeated 10 times.

EXAMPLE 28

Toner images were formed on a commercially available copy paper and peeled therefrom in the same manner as in Example 21 except that the image removal promoting liquid for use in Example 21 was replaced by an aqueous solution containing a commercially available surfactant "BT-9" (Trademark, made by Nikko Chemicals Co., Ltd.) in an amount of 0.05 wt. %, and the coating amount of the image removal promoting liquid onto the copy paper was changed from about 0.8 mg/cm$^3$ to about 0.32 mg/cm$^2$, that is, 0.2 g/A4 size.

As a result, a copy paper free from images with excellent surface smoothness was obtained.

The thus recycled PPC paper was again subjected to the image formation process using the same copying machine as previously employed. As a result, clear toner images were formed on the copy paper exactly in the same state as first formed.

The above operation of image formation and image peeling was repeated 10 times. Clear toner images were formed on the copy paper exactly in the same state as first formed even after the above operation was repeated 10 times.

EXAMPLE 29

Toner images were formed on a commercially available copy paper and peeled therefrom in the same manner as in Example 21 except that the image removal promoting liquid for use in Example 21 was replaced by an aqueous solution containing a commercially available surfactant "BT-12" (Trademark, made by Nikko Chemicals Co., Ltd.) in an amount of 0.02 wt. %, and the coating amount of the image removal promoting liquid onto the copy paper was changed from about 0.8 mg/cm$^3$ to about 1.12 mg/cm$^3$, that is, 0.7 g/A4 size.

As a result, a copy paper free from images with excellent surface smoothness was obtained.

The thus recycled PPC paper was again subject to the image formation process using the same copying machine as previously employed. As a result, clear toner images were formed on the copy paper exactly in the same state as first formed.

The above operation of image formation and image peeling was repeated 10 times. Clear toner images were formed on the copy paper exactly in the same state as first formed even after the above operation was repeated 10 times.

EXAMPLE 30

Toner images were formed on a commercially available copy paper and peeled therefrom in the same manner as in Example 21 except that the image removal promoting liquid for use in Example 21 was replaced by an aqueous solution containing a commercially available surfactant "BT-7" (Trademark, made by Nikko Chemicals Co., Ltd.) in an amount of 2 wt. %, and the coating amount of the image removal promoting liquid onto the copy paper was changed from about 0.8 mg/cm$^2$ to about 0.16 mg/cm$^3$, that is, 0.1 g/A4 size.

As a result, a copy paper free from images with excellent surface smoothness was obtained.

The thus recycled PPC paper was again subjected to the image formation process using the same copying machine as previously employed. As a result, clear toner images were formed on the copy paper exactly in the same state as first formed.

The above operation of image formation and image peeling was repeated 10 times. Clear toner images were formed on the copy paper exactly in the same state as first formed even after the above operation was repeated 10 times.

EXAMPLE 31

Toner images were formed on a commercially available copy paper and peeled therefrom in the same manner as in Example 21 except that the image removal promoting liquid for use in Example 21 was replaced by an aqueous solution containing a commercially available surfactant "BT-7" (Trademark, made by Nikko Chemicals Co., Ltd.) in an amount of 5 wt. % and a starch as a water-soluble polymer in an amount of 3 wt. %, and the coating amount of the image removal promoting liquid onto the copy paper was changed from about 0.8 mg/cm$^2$ to about 0.08 mg/cm$^2$, that is, 0.5 g/A4 size.

As a result, a copy paper free from images with excellent surface smoothness was obtained.

The thus recycled PPC paper was again subjected to the image formation process using the same copying machine as previously employed. As a result, clear toner images were formed on the copy paper exactly in the same state as first formed.

The above operation of image formation and image peeling was repeated 10 times. Clear toner images were formed on the copy paper exactly in the same state as first formed even after the above operation was repeated 10 times.

EXAMPLE 32

Toner images were formed on a commercially available copy paper and peeled therefrom in the same manner as in Example 21 except that the image removal promoting liquid for use in Example 21 was replaced by an aqueous solution containing a commercially available surfactant "BT-7" (Trademark, made by Nikko Chemicals Co., Ltd.) in an amount of 1 wt. % and carboxymethyl cellulose as a water-soluble polymer in an amount of 2 wt. %, and the coating amount of the image removal promoting liquid onto the copy paper was changed from about 0.8 mg/cm$^2$ to about 0.11 mg/cm$^3$, that is, 0.7 g/A4 size.

As a result, a copy paper free from images with excellent surface smoothness was obtained.

The thus recycled PPC paper was again subjected to the image formation process using the same copying machine as previously employed. As a result, clear toner images were formed on the copy paper exactly in the same state as first formed.

The above operation of image formation and image peeling was repeated 10 times. Clear toner images were formed on the copy paper exactly in the same state as first formed even after the above operation was repeated 10 times.

EXAMPLE 33

Toner images were formed on a commercially available copy paper and peeled therefrom in the same manner as in Example 21 except that the image removal promoting liquid for use in Example 21 was replaced by an aqueous solution containing a commercially available surfactant "BT-9" (Trademark, made by Nikko Chemicals Co., Ltd.) in an amount of 20 wt. % and carboxymethyl cellulose as a water-soluble polymer in an amount of 2 wt. %, and the coating amount of the image removal promoting liquid onto the copy paper was changed from about 0.8 mg/cm$^2$ to about 0.11 mg/cm$^3$, that is, 0.7 g/A4 size.

As a result, a copy paper free from images with excellent surface smoothness was obtained.

The thus recycled PPC paper was again subjected to the image formation process using the same copying machine as previously employed. As a result, clear toner images were formed on the copy paper exactly in the same state as first formed.

The above operation of image formation and image peeling was repeated 10 times. Clear toner images were formed on the copy paper exactly in the same state as first formed even after the above operation was repeated 10 times. In addition, the surface properties of the copy paper were not impaired after the operation was repeated 10 times.

As previously mentioned in Examples 21 through 33, the image-constituting material deposited on the recording material can be removed therefrom when the image-deposited recording material and the image release member are transported in relatively opposite directions to generate the slippage therebetween. In such a recycling apparatus that the image-deposited recording material and the image release member are transported in relatively opposite directions or in the same direction with different relative speeds, it is possible to make the transporting speed of the image release member slower than that of the recording material. In this case, there is the advantage that the cleaning of the image release member can be facilitated.

For instance, in Example 21, the transporting speed of the image release endless belt X5 as shown in the apparatus of FIG. 11 is 1/10 that of the recording material. Therefore, the image release endless belt X5 can be cooled to room temperature after the image-constituting material is transferred to the image release endless belt X5. In addition, since the transporting speed of the image release endless belt X5 is relatively slower than the recording material, more recording materials can be processed in a predetermined time as compared with the case where the transporting speed of the image release endless belt is the same as that of the recording material. In this case, the amount of image-constituting material deposited to the surface of the image release endless belt X5 is necessarily increased. As mentioned above, because the image-constituting material remaining on the belt X5 is sufficiently cooled when reaching the position of the cleaning claw E and the image-constituting material is accumulated on the surface of the belt X5, the cleaning properties of the image release endless belt X5 are remarkably improved.

However, the slippage between the image-deposited recording material and the image release member becomes considerable in the above-mentioned recycling apparatus in which the image-deposited recording material and the image release member are transported in relatively opposite directions or in the same direction with different relative speeds. Therefore, in the case where a recording material partially bears large-sized solid images thereon, the slippage cannot be satisfactorily generated between such a solid-image-bearing recording material and the image release member, and consequently, the recording material easily becomes creased during the recycling process. With the problem of the recording material becoming creased taken into consideration, it is preferable to employ the recycling apparatus capable of causing the proper slippage between the image-deposited recording material and the image release member, and allowing the image-deposited recording material and the image release member to substantially move at the same speed. The apparatus as shown in FIG. 9 is considered to be advantageous from the above-mentioned aspects, but it has the drawback that the image-constituting material may not be attached to the surface of the image release member sufficiently when the tension applied to the image release endless belt is insufficient. This is because the adhesion of the image-constituting material to the image release member simply depends on the pressure applied to the image-deposited recording material by the image release endless belt, which is generated by the predetermined tension applied to the image release endless belt. The application of an excessive tension will curtail the life of the image release endless belt.

Figure 13:
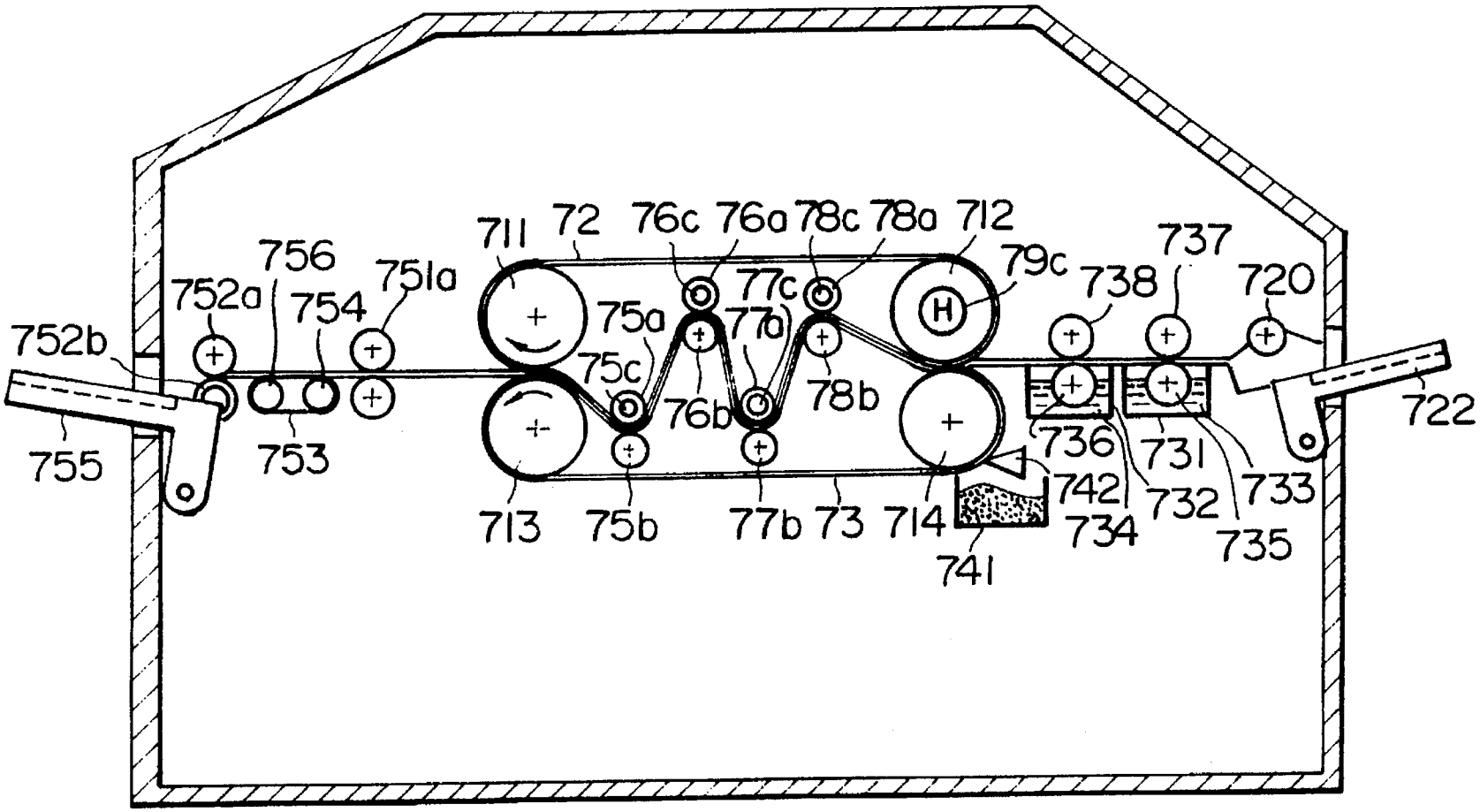
FIG. 13 is a schematic view which shows an example of the recycling apparatus according to the present invention, used in Example 34.
Figure 14:
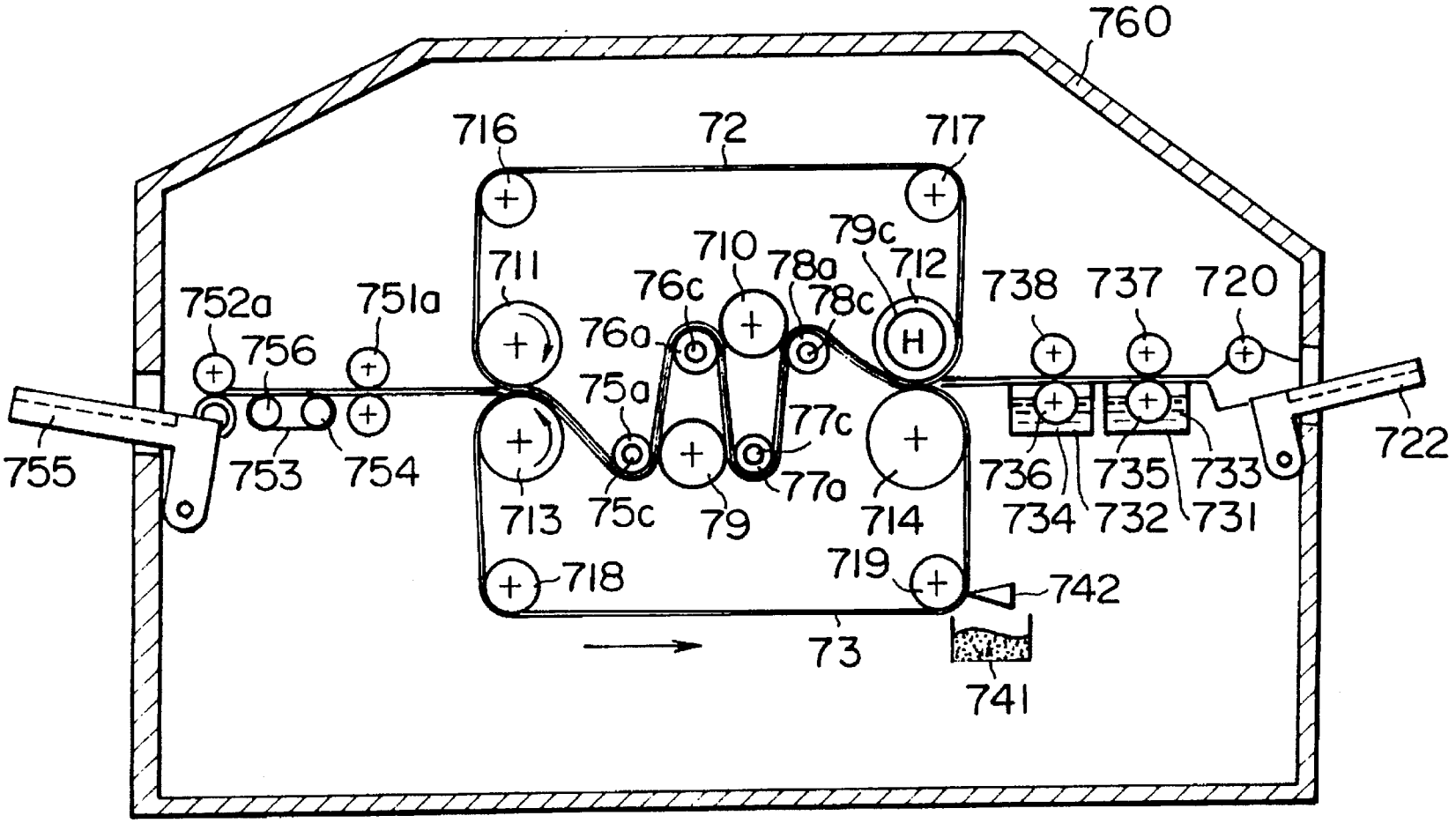
FIG. 14 is a schematic view which shows an example of the recycling apparatus according to the present invention, used in Example 38.

In the light of the aforementioned problems, an apparatus as illustrated in FIG. 13 or 14 is more preferable.

The apparatus as shown in FIG. 13 can be obtained by modifying the apparatus of FIG. 7, namely, by disposing the pairs of pressure-application rollers 75*a* and 75*b*, 76*a* and 76*b*, 77*a* and 77*b*, and 78*a* and 78*b* in the zigzag configuration. Because each pair of pressure-application rollers are urged to each other by a pressure-application means (not shown), an image-deposited recording material can be transported along the zigzag path, with closely adhering to an image release endless belt 73. In addition, heaters 75*c*, 76*c*, 77*c*, 78*c* and 79*c*, each of which is controlled to a predetermined temperature, are respectively set in the rollers 75*a*, 76*a*, 77*a*, 78*a* and 712 to heat the image-deposited recording material.

Owing to the above-mentioned configuration of the apparatus of FIG. 13, it is not necessary to apply a considerable tension to the image release endless belt 73 or a sealing endless belt 72, and at the same time, the proper slippage can be caused to occur between the image-deposited recording material and the image release endless belt 73. Thus, the image-constituting material deposited on the recording material can be satisfactorily attached to the surface of the image release endless belt 73.

In particular, to remove the image-constituting material from the recording material more efficiently, it is preferable to form a nip between the circumscribed roller, that is, the roller 75*b*, 76*a*, 77*b* or 78*a*, and the inscribed roller, that is, the roller 75*a*, 76*b*, 77*a* or 78*b* so that an inscribed roller may slightly cut into the corresponding circumscribed roller. More specifically, the hardness of a material for use in the surface layer of the circumscribed roller may be made smaller than that for use in the surface layer of the inscribed roller.

In an apparatus as shown in FIG. 14, rollers 79 and 710 are provided so as to simultaneously apply the pressure to a plurality of pressure-application rollers in order to reduce the number of pressure-application rollers disposed along the zigzag path as in FIG. 13.

The same reference numerals designate identical or corresponding parts throughout FIGS. 7, 13 and 14.

In the method or apparatus for recycling the image-deposited recording material according to the present invention, it is preferable that the coating amount of the image removal promoting liquid to the image-deposited surface portion of the recording material be in a range of 8 $\mu g/cm^2$ to 8 $mg/cm^3$, that is, 0.005 g/A4 size to 5 g/A4 size, and more preferably in a range of 0.32 $mg/cm^3$ to 8 $mg/cm^2$, that is, 0.2 g/A4 size to 5 g/A4 size. Therefore, the coating amount of the image removal promoting liquid may be determined within the above-mentioned range in the light of the conditions of the system to be employed, for example, the kind of recording material, the kind of image-constituting material, the size of recycling apparatus, and consumption of electrical power.

When the coating amount of the image removal promoting liquid is too small, the adhesion between the surface portion of the recording material and the image-constituting material is not sufficiently reduced. On the contrary, the adhesion of the image-constituting material to the recording material may be increased when the image-constituting material is heated to cause it to transfer to the image release member. Thus, the image-constituting material cannot be removed from the recording material completely. Furthermore, the surface portion of the recording material is also transferred to the image release member. In addition, the kind of recording material and the kind of image-constituting material, which can be subjected to the recycling process, are limited.

When the coating amount of the image removal promoting liquid is too large, the energy required to dry the recording material becomes too large after the image removal process, and the image-deposited recording material cannot be smoothly transported in the apparatus.

As previously mentioned, the favorable results can be obtained when the image removal promoting liquid for use in the present invention comprises water and a surfactant or/and a water-soluble polymer. In particular, when a silicone-based surfactant or fluorine-containing surfactant is contained in the image removal promoting liquid, the image-constituting material deposited on the recording material can be removed therefrom in a good condition even by a small amount of image removal promoting liquid.

As for the silicone-based surfactant, it is preferable that a hydrophobic group of the surfactant comprise methylsiloxane and a hydrophilic group thereof comprise polyalkylene oxide and/or carboxylic acid group. Specific examples of the preferable silicone-based surfactant for use in the present invention are as follows:

TABLE 1

| General Formula | Trademark |
|---|---|
| 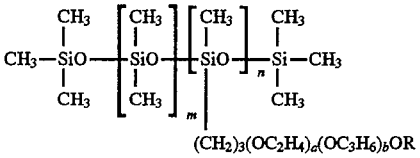 <br>R: H or a lower alkyl group<br>m, n: integers of 2 or more<br>a, b: integers of 0 or more provided a and b are not 0 at the same time. | "SH3746", "SH37771", made by Dow Corning Toray Silicone Co., Ltd. "FZ2161", "FZ2162", made by Nippon Unicar Co., Ltd. "TSF4452", made by Toshiba Silicone Co., Ltd. |
| 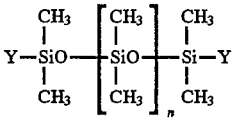 <br>Y: $(CH_2)_3(OC_2H_4)_a(OC_3H_6)_bOR$<br>R: H or a lower alkyl group<br>n: integers of 1 or more<br>a, b: integers of 0 or more provided a and b are not 0 at the same time. | "SH8427", made by Dow Corning Toray Silicone Co., Ltd. |
| 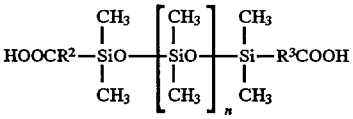 <br>$R^2$, $R^3$: polyalkylene oxide or an alkyl group<br>n: integers of 1 or more | "BY16-750", made by Dow Corning Toray Silicone Co., Ltd. "TSF4770", made by Toshiba Silicone Co., Ltd. |
| 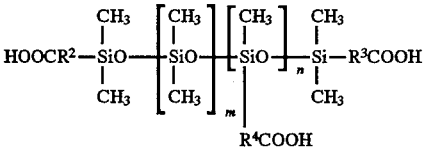 <br>$R^2$, $R^3$, $R^4$: polyalkylene oxide or an alkyl group<br>m, n: integers of 1 or more | "SF8418", made by Dow Corning Toray Silicone Co., Ltd. "TSF4771", made by Toshiba Silicone Co., Ltd. |

As for the fluorine-containing surfactant, any of anionic, nonionic, cationic and ampholytic surfactants may be employed.

Examples of the fluorine-containing surfactant for use in the present invention are fluoroalkyl($C_2$–$C_{20}$)carboxylic acid and salts thereof, perfluoroalkyl-carboxylic acid and salts thereof, perfluoroalkyl($C_4$–$C_{12}$)sulfonic acid and salts thereof, N-perfluorooctanesulfonylglutamic acid and salts thereof, 3-[fluoroalkyl($C_6$–$C_{11}$)oxyl]-1-alkyl($C_3$–$C_4$) sulfonic acid and salts thereof, 3-[ω-fluoroalkanoyl($C_6$–$C_8$) -N-ethylamino]-1-propane-sulfonic acid and salts thereof, perfluoroalkyl($C_8$–$C_{10}$)-N-ethylsulfonylglycine and salts thereof, perfluoroalkylethylene oxide adduct, perfluorooctanesulfonic acid diethanolamide, N-propyl-N-(2-hydroxyethyl)perfluorooctanesulfonamide, bis(N-perfluorooctylsulfonyl-N-ethylaminoethyl)phosphate, perfluoroalkyl($C_6$–$C_{10}$)sulfonamide propyltrimethylammonium salt, monoperfluoroalkyl($C_6$–$C_{16}$)ethyl phosphate, and N-[3-(perfluorooctanesulfonamide)propyl]-N,N-dimethyl-N-carboxymethylene ammonium betaine.

Among the above-mentioned fluorine-containing surfactants, anionic and nonionic fluorine-containing surfactants are preferred because removal of the image-constituting material from the recording material is satisfactory even by the application of a small amount of image removal promoting liquid to the image-deposited recording material.

Each of the previously mentioned silicone-based surfactant and fluorine-containing surfactant may be used alone or in combination with other surfactants.

EXAMPLE 34

An image-constituting material deposited on a recording material was removed therefrom using the apparatus as shown in FIG. 13.

An image removal promoting liquid 733 with the following formulation was prepared:

| | wt. % |
|---|---|
| Polyoxyethylene alkyl ether based surfactant | 0.2 |
| Dodecylbenzenesulfonic acid | 1.0 |
| Alginic acid | 0.3 |
| Sodium fluoroalkylcarboxylate | 0.9 |
| Potassium dehydroacetate | 0.3 |

-continued

| | wt. % |
|---|---|
| (antiseptic agent) | |
| Water | 97.3 |

Toner images were formed on the same commercially available high quality paper D as used in Example 12, using a commercially available copying machine (Trademark "FT6500", made by Ricoh Company, Ltd.). The above prepared image removal promoting liquid 733 was applied to the image-deposited surface of the high quality paper D with a coating amount of about 0.48 mg/cm$^2$, that is, 0.3 g/A4 size.

After the application of the image removal promoting liquid 733 to the image-deposited paper, the image-deposited paper was transported along the zigzag path as shown in FIG. 13, so that all the images deposited on the high quality paper D were completely removed therefrom.

EXAMPLE 35

Toner images were formed on the same high quality paper D as used in Example 34 and peeled therefrom in the same manner as in Example 34 except that the image removal promoting liquid for use in Example 34 was replaced by an image removal promoting liquid with the following formulation, and the coating amount of the image removal promoting liquid onto the high quality paper D was changed from about 0.48 mg/cm$^3$ to about 0.96 mg/cm$^2$, that is, 0.6 g/A4 size:

| | wt. % |
|---|---|
| Silicone-based surfactant (comprising a carboxylic acid group as a hydrophilic group) | 0.8 |
| Sodium alkylnaphthalenesulfonate | 0.7 |
| Water | 98.5 |

As a result, all the images deposited on the high quality paper D were completely removed therefrom.

EXAMPLE 36

An image-constituting material deposited on a recording material was removed therefrom using the apparatus as shown in FIG. 13.

An image removal promoting liquid 733 with the following formulation was prepared:

| | wt. % |
|---|---|
| Sodium fluoroalkylsulfonate | 1.5 |
| Sodium dialkylsulfosuccinate | 1.4 |
| Potassium dehydroacetate (antiseptic agent) | 0.3 |
| Water | 96.8 |

Toner images were formed on the same commercially available high quality paper D as used in Example 12, using a commercially available copying machine (Trademark "FT2200", made by Ricoh Company, Ltd.). The above prepared image removal promoting liquid 733 was applied to the image-deposited surface of the high quality paper D with a coating amount of about 0.64 mg/cm$^3$, that is, 0.4 g/A4 size.

After the application of the image removal promoting liquid 733 to the image-deposited paper, the image-deposited paper was transported along the zigzag path as shown in FIG. 13, so that all the images deposited on the high quality paper D were completely removed therefrom.

EXAMPLE 37

Toner images were formed on the same high quality paper D as used in Example 36 and peeled therefrom in the same manner as in Example 36 except that the image removal promoting liquid for use in Example 36 was replaced by an image removal promoting liquid with the following formulation, and the coating amount of the image removal promoting liquid onto the high quality paper D was changed from about 0.64 mg/cm$^2$ to about 0.80 mg/cm$^2$, that is, 0.5 g/A4 size:

| | wt. % |
|---|---|
| Silicone-based surfactant (comprising a polyoxyethylene group as a hydrophilic group) | 1.2 |
| Polyoxyethylene alkyl sulfate | 0.7 |
| Potassium dehydroacetate (antiseptic agent) | 0.1 |
| Ethylene glycol (wetting agent) | 4.5 |
| Hyaluronic acid (water-soluble polymer) | 0.1 |
| Water | 93.4 |

As a result, all the images deposited on the high quality paper D were completely removed therefrom.

As previously mentioned in Examples 34 through 37, image removal can efficiently be achieved even by the application of a small amount of image removal promoting liquid when the image removal promoting liquid comprises a fluorine-containing surfactant or silicone-based surfactant. This is because the fluorine-containing surfactant or silicone-based surfactant serves to prevent the adhesion between the image-constituting material and the recording material from being produced again in the image transfer step. More specifically, water contained in the image removal promoting liquid works to weaken the adhesion of the image-constituting material to the recording material, and to prevent the adhesion between the image-constituting material and the recording material from occurring again when the image-constituting material is heated in the image transfer step. When the apparatus is designed so that the image-constituting material may be attached or transferred to the image release member and separated from the recording material by the multiple image transfer steps, it is supposed that the fluorine-containing surfactant or silicone-based surfactant can effectively prevent the adhesion between The image-constituting material and the recording material from occurring again, even though the amount of image removal promoting liquid applied to the image-deposited surface of the recording material is small.

To further decrease the amount of image removal promoting liquid, the image removal promoting liquid may be applied to the image-deposited surface of the recording material little by little two or more times. As previously mentioned in Examples 17 through 20, it is preferable that an image removal promoting liquid containing a surfactant at a relatively high concentration be first applied to the image-deposited recording material and then an image removal promoting liquid containing a surfactant at a relatively low concentration or no surfactant be applied to the image-deposited recording material the next time.

EXAMPLE 38

An image-constituting material deposited on a recording material was removed therefrom using the apparatus as shown in FIG. 14.

Toner images were formed on the same commercially available high quality paper D as used in Example 12, using a commercially available copying machine (Trademark "FT3350", made by Ricoh Company, Ltd.).

An image removal promoting liquid 733 with the following formulation was prepared:

| | wt. % |
|---|---|
| Polyoxyethylene alkyl ether (surfactant) | 15 |
| Sodium salt of higher fatty acid (surfactant) | 10 |
| Potassium sorbate (antiseptic agent) | 0.5 |
| Water | 74.5 |

The above prepared image removal promoting liquid 733 was applied to the image-deposited surface of the high quality paper D with a coating amount of about 80 $\mu g/cm^2$, that is, 0.05 g/A4 size.

An image removal promoting liquid 734 with the following formulation was prepared:

| | wt. % |
|---|---|
| Potassium sorbate (antiseptic agent) | 0.2 |
| Water | 99.8 |

The above prepared image removal promoting liquid 734 was further applied to the image-deposited surface of the high quality paper D with a coating amount of about 0.48 $mg/cm^2$, that is, 0.3 g/A4 size.

After the application of the image removal promoting liquids 733 and 734 to the image-deposited paper, the image-deposited paper was transported along the zigzag path at a linear speed of 30 mm/sec, with the surface temperature of each of the pressure- and heat-application rollers 75*a*, 76*a*, 77*a*, 78*a* and 712 being controlled to 95° C.

As a result, all the images deposited on the high quality paper D were completely removed therefrom.

The thus recycled paper was again subjected to the image formation process using the same copying machine as previously employed. As a result, clear toner images were formed on the paper exactly in the same state as first formed.

The above operation of image formation and image peeling was repeated 5 times. After the 5-time repeated operations, all the images were completely removed from the paper, and clear toner images were formed on the paper exactly in the same state as first formed.

Now, a heat-application system for the image-deposited recording material for use in the present invention will now be explained in detail.

As shown in the apparatuses of FIG. 5(*a*), FIG. 5(*b*), FIG. 5(*c*), FIG. 7, FIG. 8, FIG. 9 and FIG. 13, a heat source may be disposed on the back side of the image-deposited recording material, opposite to the image-deposited side thereof. The amount of an image removal promoting liquid applied to the image-deposited recording material can be further decreased by heating the image-deposited side of the recording material to a temperature lower than that of the back side thereof according to the above-mentioned heat-application system. In the case where the image-deposited recording material is heated under the sealed condition so that the temperature of the back side of the recording material may be higher than that of the image-deposited side thereof, the water component of the image removal promoting liquid vaporized from the back side of the recording material is condensed on the image-deposited side of the recording material. Consequently, it is supposed that the water component is much distributed on the image-deposited side of the recording material. The water component is partially concentrated in the area adjacent to the image-deposited surface portion of the recording material. Therefore, water can directly permeate through the contact point of the image-constituting material and the surface portion of the recording material, thereby easily decreasing the adhesion of the image-constituting material to the surface portion of the recording material. In addition, the adhesion between the image-constituting material and the surface portion of the recording material once weakened may be again increased when the image-constituting material is heated to be attached or transferred to the image release member by the application of pressure thereto, as previously mentioned. Such a phenomenon can be prevented effectively by much distribution of the water component on the image-deposited side of the recording material.

In the case where the heat source was disposed on the image-deposited side of the recording material, using the apparatuses as shown in FIG. 5(*a*), FIG. 5(*b*), FIG. 5(*c*), FIG. 7, FIG. 8, FIG. 9 and FIG. 13, the amount of image removal promoting liquid required to completely remove the images from the recording material was increased by approximately 25 to 100% in any apparatus as compared with the case where the heat source was disposed on the back side of the recording material.

Furthermore, it is preferable that the image-deposited recording material be heated to a temperature lower than the boiling point of the water component for use in the water-containing image removal promoting liquid. In this case, the boiling point of the water component does not mean the theoretical boiling point of water obtained under the application of normal pressure. The boiling point of the water component for use in the water-containing image removal promoting liquid varies depending on the formulation of the image removal promoting liquid and the environmental pressure during the recycling operation. Namely, a rise in the boiling point of the water component is induced because of other components than water component in the formulation of the image removal promoting liquid, and a fall in the boiling point of the water component is caused as a matter of course when the environmental pressure is lowered.

The water component of the image removal promoting liquid can be substantially prevented from evaporating and escaping from the image-deposited recording material to the utmost by maintaining the temperature at which the image-deposited recording material is heated to be lower than the boiling point of the water component for use in the water-containing image removal promoting liquid. It has been confirmed that it is possible to sufficiently lower the adhesion of the image-constituting material to the recording material even though the heating temperature is as low as mentioned above. Therefore, it is preferable that the image-deposited recording material be heated to a temperature lower than the boiling point of the water component before the image transfer step. For instance, in the apparatuses as shown in FIGS. 5(*a*), 5(*b*), 5(*c*), 7, 8, 9, 10, 13, and 14, the surface temperature of the heat-application means for the image-deposited recording material such as the heat-application drum may be controlled to a temperature lower than the boiling point of the water component of the image removal promoting liquid employed. More preferably, the surface temperature of the heat-application means may be lower than the water component of the image removal promoting liquid, and higher than the softening or fusing point of the image-constituting material. The softening or fusing point of the image-constituting material generally used in the electrophotography, thermal image transfer, or hot-melt ink jet method, is commonly in a range of 60° to 90° C. Thus, the image-constituting material can be efficiently attached or transferred to the image release member. Further, the peeling properties of the image-constituting material from the recording material are improved even by the application of a small amount of image removal promoting liquid to the image-deposited surface portion of the recording material.

After the image transfer step, depending upon the circumstances, the recording material may be rather heated to a temperature higher than the boiling point of the water component of the image removal promoting liquid under the sealed condition. This is limited to the case where the properties of the image-constituting material employed are such that the image-constituting material is not easily attached to the recording material again, once separated therefrom and attached or transferred to the image release member. It is determined by various factors, such as the magnitude of pressure applied to the recording material in the course of image transfer step, the degree of tension applied to a belt serving as the image release member, the viscoelasticity of the image-constituting material, the formulation of the image removal promoting liquid, and the coating amount of the image removal promoting liquid onto the recording material whether the image-constituting material is easily attached to the recording material again after transferred to the image release member, or not. In any case, the recording material can be dried and finished so as to have a satisfactory surface profile by heating the recording material to a temperature higher than the boiling point of the water component of the image removal promoting liquid after the image-constituting material has been attached or transferred to the image release member. The reason for this is that the image-free recording material is dried with being held between the image release member and the sealing member. The recording material does not become creased, and the roughness formed on the surface of the recording material can be compensated to some degree while the water component contained in the recording material is eliminated with the application of pressure thereto.

To achieve the above-mentioned idea in the apparatus as shown in FIGS. 7, 9, 13 or 14, comprising a plurality of, heat- and pressure-application rollers, the temperature of the heat- and pressure-application roller disposed downstream may be controlled to higher than the boiling point of the water component of the image removal promoting liquid. For example, the surface temperature of the roller 75*a* in FIG. 7, the roller 95 in FIG. 9, or the roller 75*a* in FIG. 13 or 14 may be higher than the boiling point of the water content of the image removal promoting liquid.

In the apparatus as shown in FIG. 8, the halogen lamp 84 serving as the heat source of the heat-application drum 82 may be disposed eccentrically in the drum 82, or a reflector may be provided in the heat-application drum 82 to expose a part of an inner surface of the heat-application drum 82 to strong light so that the surface temperature of the heat-application drum 82 may exceed the boiling point of the water component of the image removal promoting liquid at a position around the contact portion with the roller 810. Alternatively, a heat source may be set in the heat-application roller 85. Japanese Patent Application No. 6-52761 filed on Feb. 25, 1994; Japanese Patent Application No. 6-54532 filed on Feb. 28, 1994; Japanese Patent Application No. 6-112411 filed on May 26, 1994; and Japanese Patent Application filed on Feb. 2, 1995 are hereby incorporated by reference.

What is claimed is:

1. A method of recycling an image-deposited recording material comprising a surface portion which swells in contact with water and bears thereon deposited images comprising an image-constituting material, comprising the steps of:

(a) applying a water-containing image removal promoting liquid to said image-deposited surface portion of said recording material and sealing said image-deposited surface portion to prevent water from said removal promoting liquid from evaporating and escaping therefrom, (b) bringing an image release member into contact with said image-deposited surface portion of said recording material to transfer said images to said image release member to remove said images from said image-deposited recording material, and (c) applying heat to said image-deposited recording material to weaken the adhesion of said images to said surface portion of said recording material at least after said step (a).

2. The method of recycling said recording material as claimed in claim 1, wherein said heating step (c) is carried out during said step (b), with said image-deposited surface portion of said recording material in contact with said image release member.

3. The method of recycling said recording material as claimed in claim 2, wherein during said step (b) said heating step (c) is carried out in such a manner that said image-constituting material is softened or fused, with said image-deposited surface portion of said recording material in contact with said image release member, and thereafter said softened or fused image-constituting material is transferred to said image release member with the application of pressure to said image-deposited recording material and said image release member.

4. The method of recycling said recording material as claimed in claim 2, wherein during said step (b) said heating step (c) is carried out in such a manner that said image-constituting material is softened or fused, with said image-deposited surface portion of said recording material in contact with said image release member, and thereafter said heating step (c) is again carried out while said softened of fused image-constituting material is attached and transferred to said image release member with the application of pressure to said recording material and said image release member.

5. The method of recycling said recording material as claimed in claim 4, wherein said image-constituting material is attached and transferred to said image release member with multiple application of pressure to said recording material and said image release member.

6. The method of recycling said recording material as claimed in claim 2, wherein during said step (b) the adhesion is caused to generate between said image-constituting material and said image release member by the application of heat and/or pressure to said image-deposited recording material and said image release member, and thereafter said heating step (c) is carried out in such a manner that at least said image-deposited recording material is heated without the application of pressure to said recording material and said image release member or under the application of a pressure smaller than that applied to cause the adhesion between said image-constituting material and said image release member to generate.

7. The method of recycling said recording material as claimed in claim 2, wherein during said step (b) said heating step (c) is carried out in such a manner that at least said recording material and said image-constituting material are heated, with said image-deposited surface portion of said recording material in contact with said image release member, and said heating step (c) is again carried out while said image-constituting material is attached to said image release member with the application of pressure thereto, and thereafter said heating step (c) is further carried out in such a manner that at least said recording material is heated to completely transfer said image-constituting material to said image release member.

8. The method of recycling said recording material as claimed in claim 1, wherein said heat step (c) is carried out before said step (b) in such a manner that said image-constituting material is softened or fused, and said step (b) is carried out in such a manner that said softened or fused image-constituting material is transferred to said image release member by the application of pressure to said image-deposited recording material and said image release member.

9. The method of recycling said recording material as claimed in claim 1, wherein at least one member of said image release member, a heat-application member for said image-deposited recording material, a heat-application member for said image-constituting material deposited on said recording material, a heat-application member for said image release member, a pressure-application member for said image-deposited recording material and said image release member, a transporting member for said image-deposited recording material, or a transporting member for said image release member serves as said sealing member, each of which comprises at least one portion through which said water component of said image removal promoting liquid is not allowed to penetrate.

10. The method of recycling said recording material as claimed in claim 1, wherein said sealing member is larger than said image-deposited recording material in the width direction and/or the length direction thereof.

11. The method of recycling said recording material as claimed in claim 1, wherein said sealing member comprises a pair of sealing sheet materials which hold at least said image-deposited recording material therebetween.

12. The method of recycling said recording material as claimed in claim 11, wherein said pair of sealing sheet materials are attached to each other at peripheral portions thereof.

13. The method of recycling said recording material as claimed in claim 12, wherein said pair of sealing sheet materials are attached to each other at peripheral portions thereof by use of a pressure-sensitive adhesive or by the application of mechanical force to said peripheral portions.

14. The method of recycling said recording material as claimed in claim 1, wherein said water-containing image removal promoting liquid comprises at least one compound selected from the group consisting of a surfactant, a water-soluble polymer, and a water-soluble organic compound.

15. The method of recycling said recording material as claimed in claim 14, wherein said surfactant comprises at least one fluorine-containing surfactant or a silicone-based surfactant.

16. The method of recycling said recording material as claimed in claim 1, wherein said water-containing image removal promoting liquid is applied to said image-deposited surface portion of said recording material with a coating amount of in a range of 8 $\mu g/cm^2$ to 8 $mg/cm^2$, that is, 0.005 g/A4 size to 5 g/A4 size.

17. A method of recycling an image-deposited recording material comprising a surface portion which swells in contact with water and bears thereon deposited images comprising an image-constituting material, comprising the steps of:

(a) applying a water-containing image removal promoting liquid to said image-deposited surface portion of said recording material and sealing said image-deposited surface portion to prevent water from said removal promoting liquid from evaporating and escaping therefrom, and (b) bringing an image release member into contact with said image-deposited surface portion of said recording material to transfer said images to said image release member to remove said images from said image-deposited recording material, with causing slippage to generate between said image-deposited surface portion of said recording material and said image release member.

18. The method of recycling said recording material as claimed in claim 17, further comprising a step (c) of applying heat to said image-deposited recording material to weaken the adhesion of said images to said surface portion of said recording material at least after said step (a), with retaining the water component of said water-containing image removal promoting liquid in said image-deposited surface portion.

19. The method of recycling said recording material as claimed in claim 18, wherein said heating step (c) is carried out during said step (b), with said image-deposited surface portion of said recording material in contact with said image release member.

20. The method of recycling said recording material as claimed in claim 19, wherein during said step (b) said heating step (c) is carried out in such a manner that said image-constituting material is softened or fused, with said image-deposited surface portion of said recording material in contact with said image release member, and thereafter said softened or fused image-constituting material is transferred to said image release member with the application of pressure to said image-deposited recording material and said image release member.

21. The method of recycling said recording material as claimed in claim 19, wherein during said step (b) said heating step (c) is carried out in such a manner that said image-constituting material is softened or fused, with said image-deposited surface portion of said recording material in contact with said image release member, and thereafter said heating step (c) is again carried out while said softened or fused image-constituting material is attached and transferred to said image release member with the application of pressure to said recording material and said image release member.

22. The method of recycling said recording material as claimed in claim 19, wherein during said step (b) the adhesion is caused to generate between said image-constituting material and said image release member by the application of heat and/or pressure to said image-deposited recording material and said image release member, and thereafter said heating step (c) is carried out in such a manner that at least said image-deposited recording material is heated without the application of pressure to said recording material and said image release member or under the application of a pressure smaller than that applied to cause the adhesion between said image-constituting material and said image release member to generate.

23. The method of recycling said recording material as claimed in claim 19, wherein during said step (b) said heating step (c) is carried out in such a manner that at least said recording material and said image-constituting material are heated, with said image-deposited surface portion of said recording material in contact with said image release member, and said heating step (c) is again carried out while said image-constituting material is attached to said image release member with the application of pressure thereto, and thereafter said heating step (c) is further carried out in such a manner that at least said recording material is heated to completely transfer said image-constituting material to said image release member.

24. The method of recycling said recording material as claimed in claim 18, wherein said heating step (c) is carried out before said step (b) in such a manner that said image-constituting material is softened or fused, and said step (b) is carried out in such a manner that said softened or fused image-constituting material is transferred to said image release member by the application of pressure to said image-deposited recording material and said image release member.

25. The method of recycling said recording material as claimed in claim 17, wherein said slippage is caused to generate between said image release member and said image-deposited surface portion of said recording material by moving said image-deposited recording material and said image release member in the opposite directions to transfer said images to said image release member to remove said images from said image-deposited recording material.

26. The method of recycling said recording material as claimed in claim 17, wherein said slippage is caused to generated between said image release member and said image-deposited surface portion of said recording material by moving said image-deposited recording material and said image release member in the same direction with different speeds to transfer said images to said image release member to remove said images from said image-deposited recording material.

27. The method of recycling said recording material as claimed in claim 17, wherein said slippage is caused to generate between said image release member and said image-deposited surface portion of said recording material by moving at least one of said image-deposited recording material or said image release member intermittently, or with repeated speed variation, or repeatedly backward and forward, to transfer said images to said image release member to remove said images from said image-deposited recording material.

28. The method of recycling said recording material as claimed in claim 17, wherein said image release member is in the form of a belt, and said slippage is caused to generate between said image release member and said image-deposited surface portion of said recording material by moving said image-deposited recording material and said image release member along a zigzag transporting path to transfer said images to said image release member to remove said images from said image-deposited recording material.

29. The method of recycling said recording material as claimed in claim 17, wherein said water-containing image removal promoting liquid comprises said fluorine-containing surfactant.

30. The method of recycling said recording material as claimed in claim 17, wherein said water-containing image removal promoting liquid comprises said silicone-based surfactant.

31. An apparatus for recycling an image-deposited recording material comprising a surface portion which swells in contact with water and bears thereon deposited images comprising an image constituting material comprising:

an image removal promoting liquid application means for applying a water-containing image removal promoting liquid to said surface portion of said image-deposited recording material;

a water evaporation preventing means for substantially retaining the water component of said water-containing image removal promoting liquid in said surface portion of said image-deposited recording material to which said water-containing image removal promoting liquid has been applied comprising a sealing member comprising a sealing portion by which said image-deposited surface portion of said recording material is tightly sealed to retain the water component of said water-containing image removal promoting liquid in said surface portion;

a heat application means for heating at least said image-deposited recording material to which said water-containing image removal promoting liquid has been applied, in such a manner that the water component of said water-containing image removal promoting liquid is substantially retained in said surface portion; and an image release means comprising an image release member for removing said deposited images from said image-deposited recording material by transferring said deposited images to said image release member.

32. The apparatus as claimed in claim 31, wherein said heat application means is capable of applying heat to said image-constituting material until said image-constituting material is fused or softened, and said image release means is capable of removing said deposited images from said image-deposited recording material by transferring said fused or softened images to said image release member with the application of pressure to said image-deposited recording material and said image release member.

33. The apparatus as claimed in claim 32, wherein said image release means is capable of removing said deposited images from said image-deposited recording material by transferring said fused or softened images to said image release member with application of pressure to said image-deposited recording material and said image release member, in such a manner that the water component of said water-containing image removal promoting liquid is substantially retained in said surface portion.

34. The apparatus as claimed in claim 33, further comprising a second heat application means which is provided downstream of said image release means, for heating at least said image-deposited recording material in such a manner that the water component of water-containing image removal promoting liquid is substantially retained in said surface portion, without the application of pressure to said recording material or under the application of a pressure smaller than that applied to cause the adhesion between said image-constituting material and said image release member to generate.

35. The apparatus as claimed in claim 34, wherein said image release means is capable of removing said deposited images from said image-deposited recording material by transferring said fused or softened images to said image release member with multiple application of pressure to said image-deposited recording material and said image release member.

36. The apparatus as claimed in claim 34, wherein said second heat application means is capable of heating said image-deposited recording material to a temperature higher than the boiling point of said water component of said water-containing image removal promoting liquid when said image-deposited recording material is heated after said fused or softened images are attached and transferred to said image release member.

37. The apparatus as claimed in claim 33, wherein said image release means is capable of removing said deposited images from said image-deposited recording material by transferring said fused or softened images to said image release member with multiple application of pressure to said image-deposited recording material and said image release member.

38. The apparatus as claimed in claim 32, wherein said heat-application means is capable of heating said image-deposited recording material to a temperature lower than the boiling point of said water component of said water-containing image removal promoting liquid when said image-deposited recording material is heated before said fused or softened images are attached and transferred to said image release member.

39. The apparatus as claimed in claim 31, further comprising a second water evaporation preventing means which is provided downstream of said image release means, for substantially retaining the water component of said water-containing image removal promoting liquid in said surface portion of said image-deposited recording material; and a second heat-application means which is provided downstream of said second water evaporation preventing means, for heating at least said recording material in such a manner that the water component of said water-containing image removal promoting liquid is substantially retained in said surface portion, without the application of pressure or under the application of a pressure smaller than that applied to cause the adhesion between said image-constituting material and said image release member to generate.

40. The apparatus as claimed in claim 31, wherein said sealing member further comprises a water-penetrating portion which allows the water component to pass therethrough, which is employed for drying said recording material after image transfer.

41. The apparatus as claimed in claim 40, wherein said water-penetrating portion comprises a porous material.

42. The apparatus as claimed in claim 40, wherein said water-penetrating portion is provided with numerous holes.

43. The apparatus as claimed in claim 40, wherein said sealing member is in the form of a drum or an endless belt.

44. The apparatus as claimed in claim 31, wherein said heat-application means is capable of heating said image-deposited recording material in such a fashion that the temperature of said image-deposited surface portion of said recording material is lower than that of the back side of said recording material, opposite to said image-deposited surface portion.

45. The apparatus as claimed in claim 31, wherein said image removal promoting liquid application means is capable of applying said water-containing image removal promoting liquid to said image-deposited surface portion of said recording material by multiple steps.

46. The apparatus as claimed in claim 31, further comprising a dying means for drying said recording material before or after said recording material is separated from said image release member.

47. The apparatus as claimed in claim 31, further comprising a pressure-application means for making said surface portion of said recording material smooth after said recording material is separated from said image release member.

48. The apparatus as claimed in claim 31, wherein said water-containing image removal promoting liquid comprises at least one compound selected from the group consisting of a surfactant, a water-soluble polymer, and a water-soluble organic compound.

49. The apparatus as claimed in claim 48, wherein said surfactant comprises at least one fluorine-containing surfactant or a silicone-based surfactant.

50. An apparatus for recycling an image-deposited recording material comprising a surface portion which swells in contact with water and bears thereon deposited images comprising an image constituting material comprising:

an image removal promoting liquid application means for applying a water-containing image removal promoting liquid to said surface portion of said image-deposited recording material;

a water evaporation preventing means for substantially retaining the water component of said water-containing image removal promoting liquid in said surface portion of said image-deposited recording material to which said water-containing image removal promoting liquid has been applied;

a heat-application means for heating at least said image-deposited recording material to which said water-containing image removal promoting liquid has been applied, in such a manner that the water component of said water-containing image removal promoting liquid is substantially retained in said surface portion;

an image release means comprising an image release member for removing said deposited images from said image-deposited recording material by transferring said deposited images to said image release member, and a slippage generating means for causing slippage to generate between said image-deposited surface portion of said recording material and said image release member to transfer said deposited images to said image release member.

51. The apparatus as claimed in claim 50, wherein said slippage generating means is capable of moving said image-deposited recording material and said image release member in the opposite directions.

52. The apparatus as claimed in claim 50, wherein said slippage generating means is capable of moving said image-deposited recording material and said image release member in the same direction with different speeds.

53. The apparatus as claimed in claim 50, wherein said slippage generating means is capable of moving at least one of said image-deposited recording material or said image release member intermittently, or with repeated speed variation, or repeatedly backward and forward.

54. The apparatus as claimed in claim 53, wherein said member for moving at least one of said image-deposited recording material or said image release member with repeated speed variation comprises an eccentric roller and/or a roller provided with convex and concave portions thereon.

55. The apparatus as claimed in claim 50, wherein said image release member is in the form of a belt, and said slippage generating means is capable of moving said image-deposited recording material and said image release member along a zigzag transporting path.

56. The apparatus as claimed in claim 50, further comprising a recording material holding means for holding the end portion of said image-deposited recording material while said image-deposited recording material is transported in contact with said image release member to transfer said deposited imaged to said image release member in a stable condition.

57. The apparatus as claimed in claim 50, wherein said water evaporation preventing means comprises a sealing member comprising a portion through which said water component of said image removal promoting liquid is not allowed to penetrate.

58. The apparatus as claimed in claim 57, wherein at least one member of said image release member, a heat-application member for said image-deposited recording material, a heat-application member for said image-constituting material deposited on said recording material, a heat-application member for said image release member, a pressure-application member for said image-deposited recording material and said image release member, a transporting member for said image-deposited recording material, or a transporting member for said image release member serves as said sealing member, each of which comprises at least one portion through which said water component of said image removal promoting liquid is not allowed to penetrate.

59. The apparatus as claimed in claim 57, wherein said sealing member is larger than said image-deposited recording material in the width direction and/or the length direction thereof.

60. The apparatus as claimed in claim 57, wherein said sealing member for use in said water evaporation preventing means comprises a pair of endless belts, at least one of which can serve as said image release member, and said pair of endless belts are disposed in such a configuration that said image-deposited recording material is transported between said pair of endless belts with said image-deposited surface portion of said recording material in contact with one of said endless belts which can serve as said image release member and the other surface of said recording material in contact with the other endless belt.

61. The apparatus as claimed in claim 60, wherein said image release means comprises a plurality of pairs of rollers, each pair of rollers capable of applying heat and/or pressure to said image-deposited recording material and said pair of endless belts, disposed so as to urge said pair of endless belts to each other from both sides thereof.

62. The apparatus as claimed in claim 61, wherein said plurality of pairs of rollers are disposed to form a zigzag transporting path for said image-deposited recording material.

63. The apparatus as claimed in claim 62, wherein some tension is applied to at least one of said endless belts to apply pressure to said image-deposited surface portion of said recording material.

64. The apparatus as claimed in claim 57, wherein said sealing member for use in said water evaporation preventing means comprises a drum and an endless belt, at least one of which can serve as said image release member, and said drum and said endless belt are disposed in such a configuration that said image-deposited recording material is transported between said drum and said endless belt with said image-deposited surface portion of said recording material in contact with said drum or said endless belt which can serve as said image release member and the other surface in contact with said drum or said endless belt.

65. The apparatus as claimed in claim 64, wherein said image release means comprises at least one roller, capable of applying heat and/or pressure to said image-deposited recording material, said drum and said endless belt, disposed so as to urge said endless belt to said drum.

66. The apparatus as claimed in claim 57, wherein said sealing member comprises a portion in contact with said image-deposited surface portion of said recording material, comprising a low-surface-energy material with a surface energy of 20 mN/m or less or a high-surface-energy material with a surface energy of 40 mM/m or more.

67. The apparatus as claimed in claim 50, wherein said water-containing image removal promoting liquid comprises said fluorine-containing surfactant.

68. The apparatus as claimed in claim 60, wherein said water-containing image removal promoting liquid comprises said silicone-based surfactant.

* * * * *

UNITED STATES PATENT AND TRADEMARK OFFICE

CERTIFICATE OF CORRECTION

PATENT NO. : 5,643,380

DATED: : JULY 1, 1997

INVENTOR(S) : TADASHI SAITOH ET AL

It is certified that error appears in the above-identified patent and that said Letters patent is hereby corrected as shown below:

Column 1, line 56, "images form" should read --images from--.

Column 3, line 2, "referring in Fig. 1" should read --referring to Fig. 1 --.

Column 3, line 57, "process as high" should read --process at high--.

Column 4, line 25, "contact are" should read --contact area--.

Column 7, line 24, "necessarily by" should read --necessarily be--.

Column 7, line 37, "it is believe" should read --it is believed--.

Column 11, line 32, "high resistance" should read --high heat resistance--.

Column 11, line 62, "at least on time" should read --at least one time--.

Column 13, line 6, "portion which" should read --portion with--.

UNITED STATES PATENT AND TRADEMARK OFFICE

CERTIFICATE OF CORRECTION

PATENT NO. : 5,643,380
DATED: : JULY 1, 1997
INVENTOR(S) : TADASHI SAITOH ET AL

It is certified that error appears in the above-identified patent and that said Letters patent is hereby corrected as shown below:

Column 14, line 25, "Figs. 2 a)" should read --Figs. 2 (a)--.

Column 16, line 5, "in Fig. 2 h," should read --in Fig. 2(h),--.

Column 16, line 65, "recording material" should read --recording material.--.

Column 19, line 23, "peeling ration of" should read --peeling ratio of--.

Column 19, line 52, "films to that" should read --films so that--.

Column 20, line 11, "FT2000" should read --FT 2200--.

Column 22, line 22, "Example (b 3" should read --Example 3--.

Column 23, line 65, "Figs. 5(i a)" should read --Figs. 5(a)--.

Column 24, line 6, "is coated by a low-surface" should read --because the surface--.

UNITED STATES PATENT AND TRADEMARK OFFICE

CERTIFICATE OF CORRECTION

PATENT NO. : 5,643,380
DATED: : JULY 1, 1997
INVENTOR(S) : TADASHI SAITOH ET AL

It is certified that error appears in the above-identified patent and that said Letters patent is hereby corrected as shown below:

Column 24, line 14, "FIG. 5(a), 5(b(" should read --FIG. 5(a), 5(b)--.

Column 25, line 1, "of about 35 82 m" should read --of about 35 μm--.

Column 25, line 22, "heaters 75c, 76c, 78c" should read --heaters 75c, 76c, 77c, 78c--.

Column 25, line 41, "with being held" should read --while being held--.

Column 26, line 17, "FIG. 8is" should read --FIG. 8 is--.

Column 26, line 47, "peeling ration" should read --peeling ratio--.

Column 26, line 65, "Trademark, "FT6500" should read --Trademark FT 6500--.

Column 27, line 58, "ten time" should read --ten times--.

Column 27, line 65, "attached transferred" should read --attached and transferred--.

UNITED STATES PATENT AND TRADEMARK OFFICE

CERTIFICATE OF CORRECTION

PATENT NO. : 5,643,380

DATED: : JULY 1, 1997

INVENTOR(S) : TADASHI SAITOH ET AL

It is certified that error appears in the above-identified patent and that said Letters patent is hereby corrected as shown below:

Column 30, line 37, "claws 938a938b" should read --claws 938a and 938b--.

Column 31, line 21, "coating among" should read --coating amount--.

Column 31, line 32, "heated to 90°" should read --heated from 90°--.

Column 33, line 39, "about 0.48 mg/cm$^3$" should read --about 0.48mg/cm$^2$--.

Column 34, line 32, "softened of fused" should read --softened or fused--.

Column 38, line 3, "with causing" should read --while causing--.

Column 38, line 34, "0.61 mg/cm$^3$" should read -- 0.61mg/cm$^2$--.

Column 39, line 33, "0.32 mg/cm$^3$" should read -- 0.32mg/cm$^2$--.

Column 40, line 14, "0.64 mg/cm$^3$" should read -- 0.64mg/cm$^2$--.

UNITED STATES PATENT AND TRADEMARK OFFICE

CERTIFICATE OF CORRECTION

PATENT NO. : 5,643,380

DATED: : JULY 1, 1997

INVENTOR(S) : TADASHI SAITOH ET AL

It is certified that error appears in the above-identified patent and that said Letters patent is hereby corrected as shown below:

Column 40, line 39, "0.8 mg/cm$^3$" should read -- 0.8 mg/cm$^2$--.

Column 40, line 64, "0.8 mg/cm$^3$ to about 1.12 mg/cm$^3$" should read -- 0.8 mg/cm$^2$ to about 1.12/cm$^2$--.

Column 41, line 21, "0.16 mg/cm$^3$" should read -- 0.16 mg/cm$^2$--.

Column 42, line 7, "0.11 mg/cm$^3$, that is, 0.7 g/A4" should read -- 0.11 mg/cm$^2$, that is, 0.07 g/A4--.

Column 42, line 33, "0.11 mg/cm$^3$, that is, 0.7 g/A4" should read -- 0.11 mg/cm$^2$, that is, 0.07 g/A4--.

Column 44, line 24, "8 mg/cm$^3$" should read -- 8 mg/cm$^2$--.

Column 44, line 25, "0.32 mg/cm$^3$" should read -- 0.32 mg/cm$^2$--.

Column 45, line 52, "($C_6$-$C_{11}$)oxyl]" should read --($C_6$-$C_{11}$)oxy]--.

UNITED STATES PATENT AND TRADEMARK OFFICE

CERTIFICATE OF CORRECTION

PATENT NO. : 5,643,380 Page 6 of 6

DATED: : JULY 1, 1997

INVENTOR(S) : TADASHI SAITOH ET AL

It is certified that error appears in the above-identified patent and that said Letters patent is hereby corrected as shown below:

Column 47, line 30, "0.48 mg/cm$^3$" should read -- 0.48 mg/cm$^2$--.

Column 47, line 66, "0.64 mg/cm$^3$" should read -- 0.64 mg/cm$^2$--.

Column 48, line 53, "between The image" should read --between the image--.

Column 53, line 24, "said heat step" should read --said heating step--.

Signed and Sealed this

Tenth Day of November 1998

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,643,380

DATED : July 1. 1997

INVENTOR(S) : Tadashi SAITOH, et al.

It is certified that error appears in the above-identified patent and that said Letters Patent is hereby corrected as shown below:

Column 2, lines 32-33, "Japanese Laid-Open Patent Application" should read --Japanese Patent Application--.

Column 2, line 44, "Japanese Laid-Open Patent Application" should read --Japanese Patent Application--.

Column 2, lines 47-48, "Japanese Laid-Open Patent Application" should read --Japanese Patent Application--.

Column 2, lines 54-55, "Japanese Laid-Open Patent Application" should read --Japanese Patent Application--.

UNITED STATES PATENT AND TRADEMARK OFFICE

CERTIFICATE OF CORRECTION

PATENT NO. : 5,643,380
DATED : Jul. 1, 1997
INVENTOR(S) : Tadashi Saitoh, et al.

It is certified that error appears in the above-identified patent and that said Letters Patent is hereby corrected as shown below:

Column 3, lines 3-4, "Japanese Laid-Open Patent Application" should read --Japanese Patent Application--

Signed and Sealed this

Twenty-ninth Day of May, 2001

Nicholas P. Godici

*Attest:*

NICHOLAS P. GODICI

*Attesting Officer*

*Acting Director of the United States Patent and Trademark Office*